US012502593B2

(12) United States Patent
Pellegrino

(10) Patent No.: US 12,502,593 B2
(45) Date of Patent: Dec. 23, 2025

(54) PROTECTIVE HAND COVERING

(71) Applicant: VICTORY GRIPS LLC, Tybee Island, GA (US)

(72) Inventor: Victor Brian Pellegrino, Tybee Island, GA (US)

(73) Assignee: VICTORY GRIPS LLC, Tybee Island, GA (US)

( * ) Notice: Subject to any disclaimer, the term of this patent is extended or adjusted under 35 U.S.C. 154(b) by 0 days.

(21) Appl. No.: 18/864,814

(22) PCT Filed: May 12, 2023

(86) PCT No.: PCT/US2023/022038

§ 371 (c)(1),
(2) Date: Nov. 11, 2024

(87) PCT Pub. No.: WO2023/220368

PCT Pub. Date: Nov. 16, 2023

(65) Prior Publication Data

US 2025/0345694 A1 Nov. 13, 2025

Related U.S. Application Data

(63) Continuation of application No. 17/744,394, filed on May 13, 2022, now Pat. No. 12,029,966.
(Continued)

(51) Int. Cl.
*A41D 13/08* (2006.01)
*A63B 71/14* (2006.01)

(52) U.S. Cl.
CPC ..... *A63B 71/141* (2013.01); *A41D 13/082* (2013.01); *A63B 2209/10* (2013.01)

(58) Field of Classification Search
CPC ..... A41D 13/082; A41D 13/081; A41D 19/0048; A63B 71/141
See application file for complete search history.

(56) References Cited

U.S. PATENT DOCUMENTS 1,369,810 A * 3/1921 Hinze ..... A41D 13/082 2/168
1,667,926 A * 5/1928 Dom Browsky .... A41D 13/082 2/20

(Continued)

FOREIGN PATENT DOCUMENTS

| | | |
|---|---|---|
| EP | 2591687 | 5/2013 |
| EP | 2633771 | 9/2013 |
| WO | WO 2022/261000 | 12/2022 |

OTHER PUBLICATIONS

International Preliminary Report on Patentability International Appln. No. PCT/US2023/022038, mailed on Nov. 28, 2024, 14 pages.

(Continued)

*Primary Examiner* — Jillian K Pierorazio
(74) *Attorney, Agent, or Firm* — Fish & Richardson P.C.

(57) ABSTRACT

Disclosed is a grip that includes a material having a wrist end, a finger end, and sides that extend from the wrist end to the finger end. The wrist end of the material has a concave shape that (i) is between the sides of the protective material and (ii) defines at least two legs on opposite sides of an apex of the concave shape. A thumb guard is defined on a first side of the sides of the material. A wrist strap is attached to a leg of the wrist end.

14 Claims, 24 Drawing Sheets

Related U.S. Application Data

(60) Provisional application No. 63/478,608, filed on Jan. 5, 2023, provisional application No. 63/345,122, filed on May 24, 2022.

(56) References Cited

U.S. PATENT DOCUMENTS 2,077,202 A * 4/1937 Barrie ..... A01J 1/00 473/59
2,769,179 A * 11/1956 Love ..... F41B 5/1473 D29/113
4,617,684 A * 10/1986 Green ..... A41D 13/082 2/19
5,298,001 A * 3/1994 Goodson ..... A63B 21/4019 2/161.1
5,350,343 A * 9/1994 DaSilva ..... A63B 21/4021 482/106
5,353,440 A * 10/1994 Meldeau ..... A41D 19/01547 2/161.1
D387,503 S * 12/1997 Ho ..... D2/610
5,704,883 A * 1/1998 Eckmann ..... A63B 21/065 482/139
5,898,944 A * 5/1999 Vrany ..... A41D 19/01547 2/163
6,119,267 A * 9/2000 Pozzi ..... A41D 13/088 2/161.1
6,279,159 B1 * 8/2001 Ahlbaumer ..... A41D 13/082 2/16
D463,566 S * 9/2002 Slautterback ..... D24/190
D710,955 S * 8/2014 Boruch ..... D21/694
9,643,073 B1 5/2017 Pellegrino
D804,589 S * 12/2017 Boruch ..... D29/113
D873,936 S * 1/2020 Pellegrino ..... D21/694
D874,585 S 2/2020 Pellegrino et al.
10,576,356 B1 * 3/2020 Pellegrino ..... A63B 71/14
10,702,761 B2 7/2020 Pellegrino
10,835,804 B1 * 11/2020 Pellegrino ..... A63B 71/14
D932,710 S * 10/2021 Jenni ..... D29/113
D979,671 S 2/2023 Pellegrino
12,029,966 B2 7/2024 Pellegrino
2005/0268374 A1 12/2005 Mattesky
2009/0126074 A1 5/2009 Mattesky
2012/0210483 A1 * 8/2012 Fricke ..... A63B 71/141 2/16
2013/0227755 A1 * 9/2013 Bisaillon ..... A63B 71/141 2/161.1
2015/0143607 A1 5/2015 Ramirez
2017/0026904 A1 1/2017 Ode
2017/0087438 A1 * 3/2017 Bisaillon ..... A41D 19/01523
2017/0296904 A1 * 10/2017 Blazhko ..... A41D 13/082
2017/0348584 A1 * 12/2017 Rhodes ..... A41D 13/0562
2018/0110269 A1 * 4/2018 Koven ..... A41D 27/08
2018/0140929 A1 * 5/2018 Pellegrino ..... A63B 71/141
2019/0001180 A1 1/2019 Pellegrino et al.
2020/0046044 A1 * 2/2020 Faim ..... A41D 13/082
2020/0121975 A1 * 4/2020 Starominsky ..... A63B 71/00
2020/0275716 A1 * 9/2020 Salvatori ..... A41D 19/0072
2021/0023435 A1 * 1/2021 Pellegrino ..... A63B 71/14
2021/0170258 A1 * 6/2021 Pellegrino ..... A63B 71/141
2023/0364490 A1 11/2023 Pellegrino

OTHER PUBLICATIONS

International Search Report and Written Opinion in International Appln. No. PCT/US2023/022038, mailed on Nov. 30, 2023, 21 pages.
Invitation to Pay Additional Fees and, Where Applicable, Protest Fee in International Appln. No. PCT/US2023/022038, mailed on Sep. 8, 2023, 14 pages.

* cited by examiner

PROTECTIVE HAND COVERING

CROSS-REFERENCE TO RELATED APPLICATION

This application is a National Stage Application under 35 U.S.C. § 371 and claims the benefit of International Application No. PCT/US2023/022038, filed May 12, 2023, which claims priority to U.S. patent application Ser. No. 17/744,394, filed on May 13, 2022, and U.S. Provisional Patent Application No. 63/345,122, filed on May 24, 2022, and U.S. Provisional Patent Application No. 63/478,608, filed on Jan. 5, 2023. The disclosure of the foregoing applications are hereby incorporated by reference in their entirety.

BACKGROUND

This specification relates to hand protection, including gloves and grips that are useful for protecting a hand during various activities, including manual labor, gymnastics, or functional fitness exercise.

There are many different activities and exercise movements that can result in injury to hands. Some of these activities can include using tools, handling sharp objects, or exercises performed on horizontal bars and gymnastics rings. During these activities skin that is exposed can experience punctures or friction that can lead to injury. Gloves or grips can help protect hands from injuries.

SUMMARY

In general, one innovative aspect of the subject matter described in this specification can be embodied in a grip with a material having a wrist end, a finger end, and sides that extend from the wrist end to the finger end. A wrist strap is attached to a leg of the wrist end of the protective material. The wrist end of the protective material has a concave shape that (i) is between the sides of the protective material and (ii) defines at least two legs on opposite sides of an apex of the concave shape.

These and other embodiments can each optionally include one or more of the following features.

The concave shape can be defined by an arched void, a semicircle void, or an angled void at the wrist end of the protective material.

The wrist strap can be secured to the protective material at an anchor location in a first leg among the at least two legs. The wrist strap can include a primary enclosure and a secondary enclosure. The primary enclosure and the secondary enclosure are arranged in a "T" configuration.

A first side of the protective material can have a cutout that is between a thumb guard and the finger end, the angle of the cutout being less than 90 degrees. The thumb guard can be formed from the material, has a shape of a plateau that is elevated relative to an inflection point of the cutout, and is formed on a first side of the sides.

The protective material can have a wrist strap hole formed through a plane that is defined by the protective material when laid flat, the wrist strap hole being on a second side of the material. The wrist strap hole can be located in a second leg that is on an opposite side of the apex of the concave shape than the anchor location. The wrist strap hole can be located in a second leg of the protective material that is on an opposite side of the apex of the concave shape than the wrist strap.

The protective material can have different widths at different locations along an axis that extends between the wrist end and the finger end. The protective material can have a most narrow width between opposite side edges being in a middle ⅓ section of the protective material The wrist strap can include an elastic section and a non-elastic section. The elastic section can be attached to the wrist end of the protective material at the anchor location. The non-elastic section can be secured to a side of the elastic section that is more proximate to the anchor location than an opposite side of the elastic section.

The protective material can have zero, one, two, three, four, or more finger holes defined through a plane formed by the protective material laid flat.

An end of the elastic section of the wrist strap that can be farthest away from the wrist strap junction includes a hook fastener material or a loop fastener material.

In general, another innovative aspect of the subject matter described in this specification can be embodied in a method that includes forming a protective material having a wrist end, a finger end, and sides that extend from the wrist end to the finger end; and attaching a wrist strap to the wrist end of the protective material, where the wrist end the protective material has a concave shape that (i) is between the sides of the protective material and (ii) defines at least two legs on opposite sides of an apex of the concave shape.

These and other embodiments can each optionally include one or more of the following features.

Forming the protective material can include forming the concave shape that defines an arched void, a semicircle void, or an angled void at the wrist end of the protective material.

Attaching the wrist strap to the protective material can include securing the wrist strap to the protective material at an anchor location in a first leg among the at least two legs. The wrist strap can include a primary enclosure and a secondary enclosure. The primary enclosure and the secondary enclosure are arranged in a "T" configuration.

Forming the protective material can include forming a first side of the protective material to have a cutout that is between a thumb guard and the finger end, the angle of the cutout being less than 90 degrees. The thumb guard can be formed from the protective material, have a shape of a plateau that is elevated relative to an inflection point of the cutout, and is formed on a first side of the sides.

Forming the protective material can include forming a wrist strap hole in a second leg that is on an opposite side of the apex of the concave shape than the anchor location. The protective material can have a wrist strap hole formed through a plane that is defined by the protective material when laid flat, the wrist strap hole can be on a second side of the material. The wrist strap hole can be formed in a second leg that is on an opposite side of the apex of the concave shape than the anchor location. The wrist strap hole can be formed in a second leg of the material that is on an opposite side of the apex of the concave shape than the wrist strap.

Forming the protective material can include forming the protective material to have different widths at different widths at different locations along an axis that extends between the wrist end and the finger end. The material can be formed to have a narrowest width between opposite side edges being in a middle ⅓ section of the protective material.

The method can include assembling the wrist strap. The wrist strap can include an elastic section and a non-elastic section that are attached at a wrist strap junction. Attaching a wrist strap to the wrist end of the protective material can include attaching the elastic section to the wrist end of the protective material at the anchor location.

Assembling the wrist strap can include securing the non-elastic section to a side of the elastic section that is more proximate to the anchor location than an opposite side of the elastic section.

Forming the protective material can include forming zero, one, two, three, four, or more finger holes through a plane formed by the protective material laid flat.

An end of the elastic section of the wrist strap that is farthest away from the wrist strap junction can include a hook fastener material or a loop fastener material.

In general, another innovative aspect of the subject matter described in this specification can be embodied in a grip with a material having a wrist end, a finger end, and sides that extend from the wrist end to the finger end. In some implementations, the wrist end of the material has a concave shape that (i) is between the sides of the protective material and (ii) defines at least two legs on opposite sides of an apex of the concave shape; and a thumb guard is defined on a first side of the sides. The grip also has a wrist strap attached to a leg of the wrist end that is on the first side with the thumb guard.

These and other embodiments can each optionally include one or more of the following features.

The concave shape can be defined by an arched void, a semicircle void, or an angled void at the wrist end of the material.

The wrist strap can include a primary enclosure and a secondary enclosure.

The primary enclosure and the secondary enclosure can be arranged in a "T" configuration.

The first side of the material can have a cutout that is between the thumb guard and the finger end, the angle of the cutout being less than 90 degrees.

The thumb guard can have a shape of a plateau that is elevated relative to an inflection point of the cutout.

The material can have a wrist strap hole formed through a plane that is defined by the material when laid flat, the wrist strap hole being on the second side of the material. The wrist strap hole can be located in a second leg of the material that is on an opposite side of the apex of the concave shape than the wrist strap and the thumb guard.

The material can have different widths at different locations along an axis that extends between the wrist end and the finger end.

The material can have zero, one, two or three finger holes defined through a plane formed by the protective material laid flat.

In general, another innovative aspect of the subject matter described in this specification can be embodied in a method that includes forming a material having a wrist end, a finger end, and sides that extend from the wrist end to the finger end, wherein: the wrist end of the material is formed to have a concave shape that (i) is between the sides of the protective material and (ii) defines at least two legs on opposite sides of an apex of the concave shape; and a thumb guard is defined on a first side of the sides; and attaching a wrist strap to a leg of the wrist end that is on the first side with the thumb guard.

These and other embodiments can each optionally include one or more of the following features.

The concave shape can be formed as an arched void, a semicircle void, or an angled void at the wrist end of the material.

The wrist strap can include a primary enclosure and a secondary enclosure.

The primary enclosure and the secondary enclosure can be arranged in a "T" configuration.

The first side of the material can be formed to have a cutout that is between the thumb guard and the finger end, the angle of the cutout being less than 90 degrees.

The thumb guard can be formed to have a shape of a plateau that is elevated relative to an inflection point of the cutout.

Forming the material can include forming a wrist strap hole through a plane that is defined by the material when laid flat, the wrist strap hole being formed on the second side of the material. The wrist strap hole can be formed in a second leg of the material that is on an opposite side of the apex of the concave shape than the wrist strap and the thumb guard.

Forming the material can include forming the material to have different widths at different locations along an axis that extends between the wrist end and the finger end.

Another innovative aspect of the subject matter described in this specification can be embodied in a hand covering that includes a palm protection area configured to cover at least a portion of a palm of a hand wearing the hand covering. The palm protection area has a non-woven composite material that is exposed on a first face of the palm protection area and a synthetic rubber material that is exposed on a second opposite face of the palm protection area. The palm protection area has different widths at different locations along an axis that extends between a wrist end of the palm protection area and a finger end of the palm protection area. The hand covering can include a wrist securing member at the wrist end of the palm protection area. These and other embodiments can each optionally include one or more of the following features.

The first face of the palm protection area can be formed to face the palm of the hand wearing the hand covering. The second opposite face of the palm protection area can be formed to face away from the palm of the hand wearing the hand covering.

The palm protection area can include a first layer of the synthetic rubber material spread over the non-woven composite and a second layer of the synthetic rubber material applied to the first layer of the synthetic rubber material. The non-woven material can include nylon and poly-paraphenylene terephthalamide.

The palm protection area can include a bonding layer that is applied to the non-woven composite. The bonding layer can include polyurethane or acrylic.

The palm protection area can include finger holes that are defined through a plane formed by the palm protection area when laid flat.

The palm protection area can be connected to finger sleeves at the finger end of the palm protection area.

The hand covering can include a different material that differs from one or more materials located on a palm face of the hand covering. The different material can be located on a backhand face of the hand covering.

The palm protection area can have zero finger holes defined therein.

In general, another innovative aspect of the subject matter described in this specification can be embodied in a method including forming a palm protection area configured to cover at least a portion of a palm of a hand. The palm protection area has a non-woven composite material that is exposed on a first face of the palm protection area and a synthetic rubber material that is exposed on a second opposite face of the palm protection area. The palm protection area has different widths at different locations along an axis that extends between a wrist end of the palm protection area and a finger end of the palm protection area. The method can include attaching a wrist securing member to the wrist end of the palm protection area. These and other embodiments can each optionally include one or more of the following features.

Forming the palm protection area can include forming the palm protection area such that the first face of the palm protection area faces the palm of the hand wearing the hand covering. Forming the palm protection area can include forming the palm protection area such that the second opposite face of the palm protection area faces away from the palm of the hand wearing the hand covering.

Forming the palm protection area can include spreading a first layer of the synthetic rubber material over the non-woven composite; and applying a second layer of the synthetic rubber material to the first layer of the synthetic rubber material. The non-woven material can include nylon and poly-paraphenylene terephthalamide.

Forming the palm protection area can include applying a bonding layer to the non-woven composite. The bonding layer can include polyurethane or acrylic.

The method can include defining one or more finger holes through a plane formed by the palm protection area when laid flat.

The palm protection area can be connected to finger sleeves at the finger end of the palm protection area.

The method can include forming a backhand face of the hand covering using a different material that differs from one or more materials located on a palm face of the hand covering.

The palm protection area can be formed to have zero finger holes defined therein.

Particular embodiments of the subject matter described in this specification can be implemented so as to realize one or more of the following advantages. The combination of materials used to create the gloves or grips can provide a high level of protection to the skin, while being comfortable to wear. Dexterity of the hand is maintained because the combination of materials remain flexible while providing a high level of durability and protection. The non-woven material to which synthetic rubber is applied is heat tolerant providing heat protection to the hand. The synthetic rubber is resistant to chemicals, heat, and UV light, providing additional protection to the hand. The synthetic rubber is also abrasion resistant, providing enhanced durability.

Particular embodiments of the subject matter described in this specification can be implemented so as to realize one or more of the following advantages. The concave shape of the wrist end of the protective material distributes the forces on the wrist when doing pulling exercises, such as pull ups, leading a more even distribution of the forces around the writs and a more comfortable fit. The elastic portion of the wrist strap is wider than the non-elastic portion of the wrist strap to provide enhanced wrist support and a more comfortable fit.

In addition to the foregoing, the combination of materials used to create the gloves or grips can provide a high level of protection to the skin, while being comfortable to wear. Dexterity of the hand is maintained because the combination of materials remains flexible while providing a high level of durability and protection. The non-woven material to which synthetic rubber is applied is heat tolerant providing heat protection to the hand. The synthetic rubber is resistant to chemicals, heat, and UV light, providing additional protection to the hand. The synthetic rubber is also abrasion resistant, providing enhanced durability.

The details of one or more embodiments of the subject matter described in this specification are set forth in the accompanying drawings and the description below. Other features, aspects, and advantages of the subject matter will become apparent from the description, the drawings, and the claims.

DETAILED DESCRIPTION

Figure 1A:
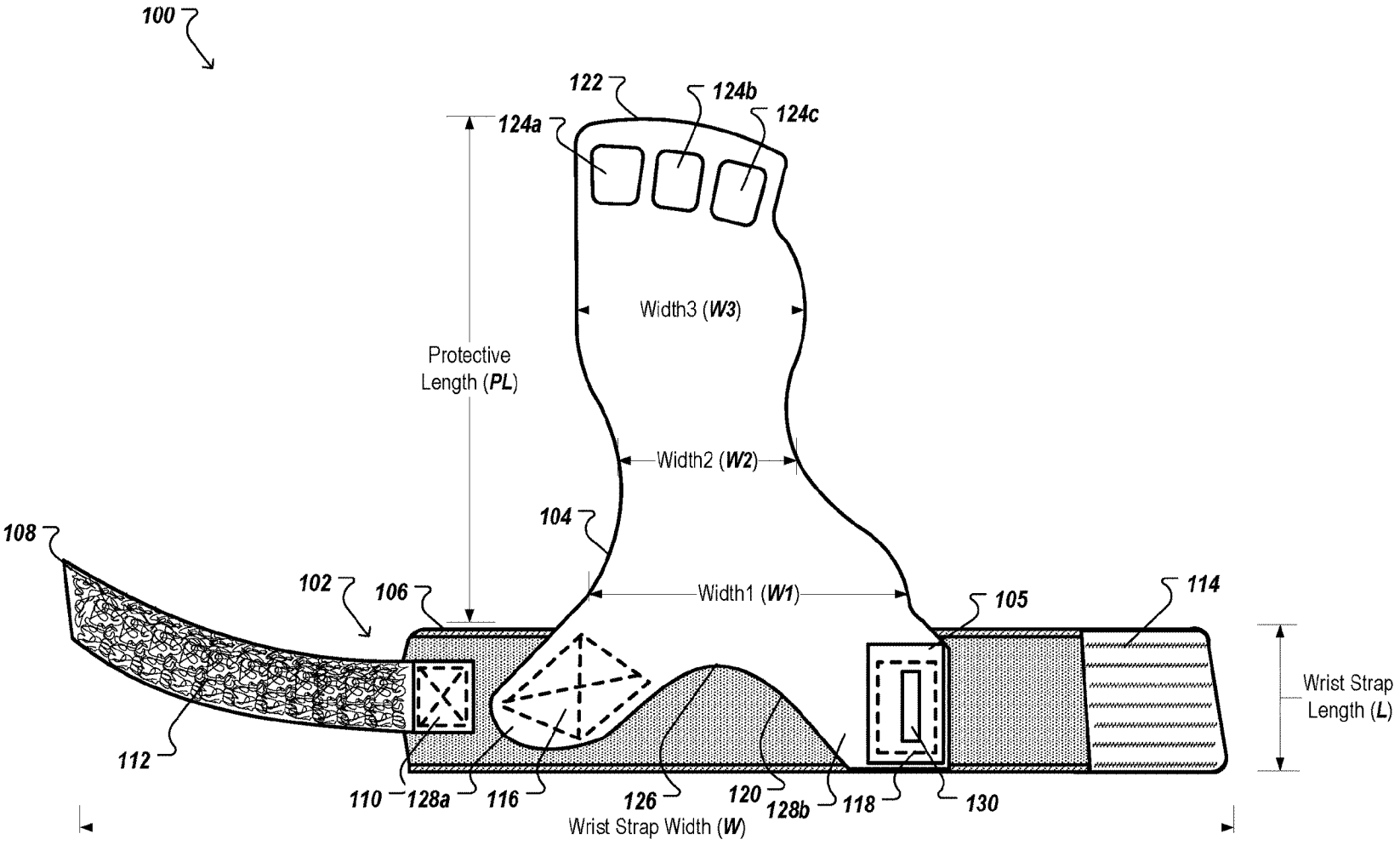
FIG. 1A is an illustration of a grip laid flat.

A hand covering (e.g., a grip or glove) is useful for protecting hands from injury during activity. For example, a grip is useful for protecting hands during exercise. The grips disclosed herein are particularly useful for protecting the palm and wrist while an athlete is performing gymnastics movements, such as pull ups, ring muscle ups, or bar muscle ups. Similarly, gloves can protect hands from injury when working with sharp or abrasive materials, or working with tools, such as a rake or shovel.

The protective material used to create the hand coverings described herein is a unique composition of materials (also referred to as a multi-layer material) that provides multiple advantages over traditional hand covering materials, such as leather. For example, the protective material has an outer layer (e.g., facing away from the palm) that provides a high grip coefficient, which enables a person wearing the hand covering to maintain a secure grip on a bar, handle, or other material they are holding. Additionally, the protective material has an inner layer (e.g., facing the palm) that is formed of a non-woven composite material that is soft to the touch, which improves the comfort of the hand protector.

A grip is a type of hand covering useful for protecting hands during exercise. Grips disclosed herein are particularly useful for protecting the palm and wrist while an athlete is performing gymnastics movements, such as pull ups, ring muscle ups, or bar muscle ups. The protective material of the grips described herein have a unique shape that has been designed to distribute the forces placed on the wrist during pulling movements, such as pull ups, which reduces the pressure that conventional grips place on certain portions of the wrist. For example, the concave shape of the wrist end of the protective material of the grips described herein distributes the force around the wrist, rather than concentrating the force on a small area of the wrist, thereby providing more comfort than traditional grips and enhancing the durability of the grips.

Wrist straps of the disclosed grips also differ from conventional grips to provide a more comfortable fit, and to provide additional wrist support as compared to conventional grips. For example, some of the wrist straps discussed have an elastic section and an inelastic/non-elastic section. The elastic section has a larger length (as measured as described herein) than the non-elastic section, and is configured to stretch around the wrist, thereby providing wrist support while performing Olympic Lifts or other exercise movements that flex the wrists. Meanwhile, the non-elastic section has a smaller length than the elastic section, and is configured to secure the wrist strap around the wrist and provide rigidity to reduce unwanted movement of the wrist strap or grip—e.g., to prevent the wrist strap from moving from the wrist of a wearer to the palm of the wearer when the non-elastic section is tightened around the wrist and secured, e.g., using a hook and loop fastener or another fastener.

The shape of the grip provides adequate coverage of portions of the palm that experience high levels of friction during these gymnastics movements, while also exposing other portions of the palm to enable better hand articulation than traditional gymnastics grips. The enhanced hand articulation provided by the present grips enables the athlete to transition between gymnastics movements and other exercises, such as Olympic lifting (e.g., clean and jerk or snatch) or powerlifting (e.g., deadlifts and bench press) while wearing the grips.

In this specification, relative widths of the protective material can be measured at different locations along a reference axis that passes through the finger end of the protective material and an edge of the wrist strap that is closest to the finger end of the protective material. The reference axis can intersect the edge of the protective material at the finger end of the protective material and be perpendicular to the edge of the wrist strap that is closest to the finger end of the protective material (e.g., a tangent of an arc apex). At each location along the reference axis, the width of the protective material can be measured between the sides of the protective material at that location on the reference axis. Meanwhile, the length of the wrist strap can be measured in the direction of the reference axis, while the width of the wrist strap, as well as the widths of the component sections of the wrist strap can be measured in a direction of an orthogonal axis that is orthogonal to the reference axis (e.g., in the same direction as the width of the protective material). Sides (or side edges) of the protective material extend from and between the finger end ant the wrist end. As used herein, the terms non-elastic and inelastic, which are used interchangeably, do not refer to absolute rigidity or an absolute lack of elasticity. Rather, these terms are used to indicate a relative difference of elasticity between the elastic material and the inelastic material, thereby indicating that the elastic material has higher elasticity than the inelastic material.

FIG. 1A is an example illustration of a grip 100 that is laid flat. The grip 100 includes a wrist strap 102 having a wrist strap width (W) and a wrist strap length (L). The grip also includes a protective material 104 that is attached to the wrist strap 102. The protective material 104 can be formed from the multi-layer material 1602 of FIGS. 16A-16B. The protective material 104 can also be formed from other appropriate materials (e.g., leather, cloth, etc.).

Figure 1B:
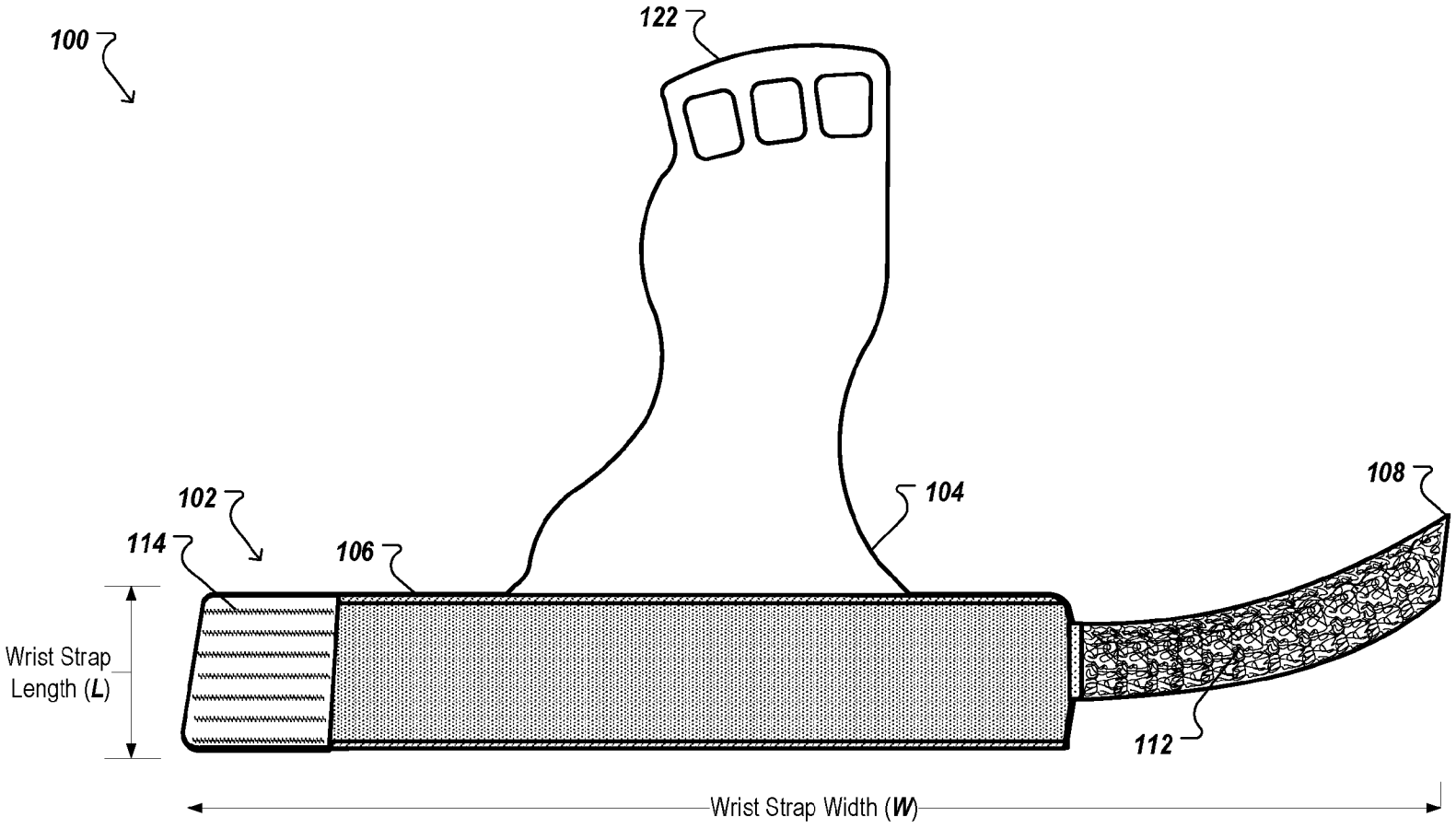
FIG. 1B is another illustration of the grip laid flat.

The protective material 104 has a wrist end 120 and a finger end 122. The surface of the protective material 104 that is shown in FIG. 1A is the surface that faces and/or come into direct contact with an athlete's palm when the grip is worn, which is also referred to as a "palm-facing surface" of the grip 100. When the protective material 104 is created using the multi-layer material 1602 of FIG. 16, the palm facing surface of the grip 100 can be the exposed non-woven material (with or without a fourth layer applied, as discussed below). The grip 100 shown in FIGS. 1A and 1B is configured to be worn on an athlete's right hand.

In some implementations, the wrist strap 102 can be formed from multiple different materials. For example, the wrist strap 102 can be formed using an elastic material 106 and an inelastic material 108. The elastic material 106 and the inelastic material 108 can be sewn together (or otherwise attached/joined) at a wrist strap junction 110, which is an area at which the elastic material 106 is secured (or otherwise joined) to the inelastic material 108. In some implementations, the inelastic material 108 can be, or include a hook (or loop) fastener material 112 that enables the inelastic material 108 to be secured to a corresponding loop (or hook) fastener material that is also part of the wrist strap 102. When referring to the wrist strap 102, a portion of the wrist strap 102 that is formed using the inelastic material 108 is referred to as the inelastic section (or non-elastic section), and the portion of the wrist strap 102 that is formed using the elastic material 106 is referred to as the elastic section. As illustrated, the non-elastic section is secured to a side of the elastic section that is more proximate to an anchor location 116 (discussed below) than the opposite side of the elastic section at which a fastener section 114 is located. In some implementations, the length of the elastic section is larger than the length of the non-elastic section. For example, in some implementations, the distance between a top edge (e.g., closest to a most distal edge of the finger end) and a bottom edge (e.g., farthest from the most distal edge of the finger end) of the non-elastic section will be smaller than a distance between the top edge and the bottom edge of the elastic section.

Portions of the wrist strap 102 can be formed separate from the protective material 104, and sewn, or otherwise attached (e.g., with adhesive) to the protective material 104. For example, the elastic section of the wrist strap 102 can be sewn to the protective material 104 at the anchor location 116. The anchor location 116 refers to an area at which the protective material 104 and the wrist strap 102 are joined together. As illustrated by FIG. 1A, the protective material 104 and the wrist strap 102 are joined together using stitching in a cross pattern within rectangle stitching, but any appropriate manner of joining the wrist strap 102 and the protective material 104 can be used. Also, FIG. 1A, shows that there is only one anchor location 116 that joins the wrist strap 102 and the protective material 104, which is a way to connect the elastic material 106 to the protective material 104 without overly limiting the elastic properties of, and/or comfort provided by, the elastic section of the wrist strap 102. However, it is possible to join the wrist strap 102 and the protective material 104 using multiple anchor locations 116.

As shown, a single anchor location 116 is located closer to one side of the elastic material 106 than the other side of the elastic material 106 (i.e., closer to the left side edge of the width than the right edge). In this example, the protective material 104 is attached to one side of the elastic section, and not connected to the opposite side of the elastic section.

To distribute forces exerted on the wrist by the grip when performing pulling movements (e.g., performing pull ups on a pull up bar), the edge of the wrist end 120 has a concave shape between the sides of the protective material 104. The sides of the protective material 104 are the edges of the protective material that extend from and between the wrist end 120 and the finger end 122. As shown, an apex 126 of the concave shape is at a shortest length of the protective material 104 (as measured from the mid-point of the edge of the finger end 122 and the edge of the wrist end 120 at the apex 126), and the length of the protective material 104 increases toward the sides of the protective materials 104 (assuming that the measurement location at the finger end remains fixed). The two longer sections of the protective material that are on opposite sides of the apex 126 of the concave shape can be referred to as legs of the protective material 104, and the wrist end 120 of the protective material 104 can have at least two legs 128*a*, 128*b*. As shown, the anchor location 116 is located in one leg 128*a* of the protective material 104.

The concave shape of the wrist end 120 is illustrated as defining, or being defined by, an arched void at the wrist end, such that the edge of the wrist end 120 forms a smooth curve, but the concave shape can be created/defined in other ways. For example, the concave shape can be created/defined using a semicircle void, an angled void, or another shape that creates a concave shape at the wrist end of the protective material 104.

In some implementations, a reinforcement element 105 is formed in an opposite side of the protective material 104 relative to the anchor location 116. As shown, the reinforcement element 105 is formed in the opposite leg 128*b* of the protective material than the location of the anchor location 116, which is in the leg 128*a*. The reinforcement element 105 can be formed in several ways, and is secured to the protective material 104, e.g., using stitching 118 or another securing mechanism. For example, the reinforcement element 105 can be a portion of the protective material 104 that is wrapped around the right side (in the current view) of the protective material 104 and is sewn to the protective material 104. In some implementations, the protective material 104 has a wrist strap hole 130 defined on the side of the protective material 104 around which the reinforcement element 105 is wrapped. For example, the reinforcement element 105 can have a hole defined therein, and that hole can be aligned with the wrist strap hole 130 that is defined in the leg 128*b* of the protective material 104, which is on the opposite side of the apex 126 of the concave shape than the wrist strap junction. Once the holes are aligned, the reinforcement element 105 of the wrist strap 102 can be secured (e.g., sewn) to the protective material 104. In some implementations, the reinforcement element 105 can be a separate piece of material (i.e., relative to the protective material 104) that is similarly secured to the protective material and may or may not wrap around the side of the protective material 104.

The protective material 104 can have zero, one, two, three, four, or more finger holes defined therein, and the finger holes can be defined at a location of the protective material 104 that is closer to the finger end 122 than the wrist end 120. The finger holes are defined through a plane defined by the protective material when the protective material is laid flat. FIG. 1A shows an implementation having 3 finger holes 124*a*, 124*b*, and 124*c* defined through the plane of the protective material that is laid flat.

In some implementations, the finger holes 124*a*, 124*b*, and 124*c* can be omitted from the protective material 104 to form a "fingerless" version of the grip 100 that is not worn over the fingers of the athlete. Omitting the finger holes enables the athlete to quickly transition from using the grip 100 for gymnastics movements to not using the grip 100, for example, when transitioning to perform non-gymnastics movements, without having to take the time to remove the wrist strap or otherwise take the grip off.

The width of the protective material 104 varies along a protective length (PL) of the protective material 104. In other words, the protective material has different widths at different locations along an axis that extends between (and passes through) the wrist end 120 and the finger end 122. For example, the protective material 104 has a first width (W1) at a first location that is between the anchor location 116 and a narrowest portion of the protective material 104. As illustrated, the first location of the first width (W1) is between a top edge of the elastic material 106 (e.g., an edge of the elastic material that is closer to the finger end 122 than an opposite edge of the elastic material). The protective material 104 has a second width (W2) that is further away from the top edge of the elastic material 106 than the first width (W1). As shown, the second width (W2) is smaller than the first width. The protective material has a third width (W3) that is further away from the top edge of the elastic material 106 than the second width (W2). As shown, the third width (W3) is larger than the second width (W2). In some implementations, the third width (W3), which is closer to the finger end 122 than either of the first width (W1) or the second width (W2), is smaller than the first width (W1), which is closer to the wrist end 120 than either of the second width (W2) or the third width (W3).

In some implementations, the protective length (PL) of the grip 100 (e.g., between the wrist strap and the finger end) can be referred to as a palm protection area that covers at least a portion of a palm of a hand wearing the grip 100. As discussed above, the surface (e.g., face) of the grip 100 shown in FIG. TA can be the non-woven material (of the multi-layer material 1600 discussed with reference to FIG. 16B), that is exposed on the palm-facing surface, and the opposite surface (e.g., opposite face) of the grip 100 can be the synthetic rubber (e.g., CSM) of the third layer 1614 discussed below with reference to FIG. 16B. In some implementations, W2 and W3 are configured so that these portions of the grip 100 at these locations do not wrap around a hand when the grip 100 is worn with fingers passed through the finger holes 124*a*-124*c*, and the wrist strap 102 is secured around a wrist.

FIG. 1B is another illustration of the example grip 100 laid flat. The surface of the protective material 104 that is shown in FIG. 1B is the surface that faces away from an athlete's palm when the grip is worn. In FIG. 1B, the legs 128*a* and 128*b* of FIG. TA are not visible because they are occluded by the elastic material 106 in this view. As illustrated in FIG. 1B, the fastener section 114 is at the opposite end of the elastic material 106 than the inelastic material 108. The fastener section 114 can have a hook (or loop) material on this side of the wrist strap 102, on the opposite side of the wrist strap shown in FIG. 1B, or both sides can have the hook (or loop) material. Of course, the hook (or loop) material can be limited to one side as appropriate (e.g., if the hook or loop is not needed on both sides to secure the grip to a wearer's wrist). In some situations, the fastener section 114 can be a portion of the elastic material to on which the hook or loop material is secured (e.g., sewn on). In FIG. 1B, the inelastic material 108 is shown having a hook (or loop) fastener material 112 on this side of the wrist strap as well, and the hook (or loop) fastener material can similarly be included on one or both sides of the inelastic material, as appropriate.

Figure 2A:
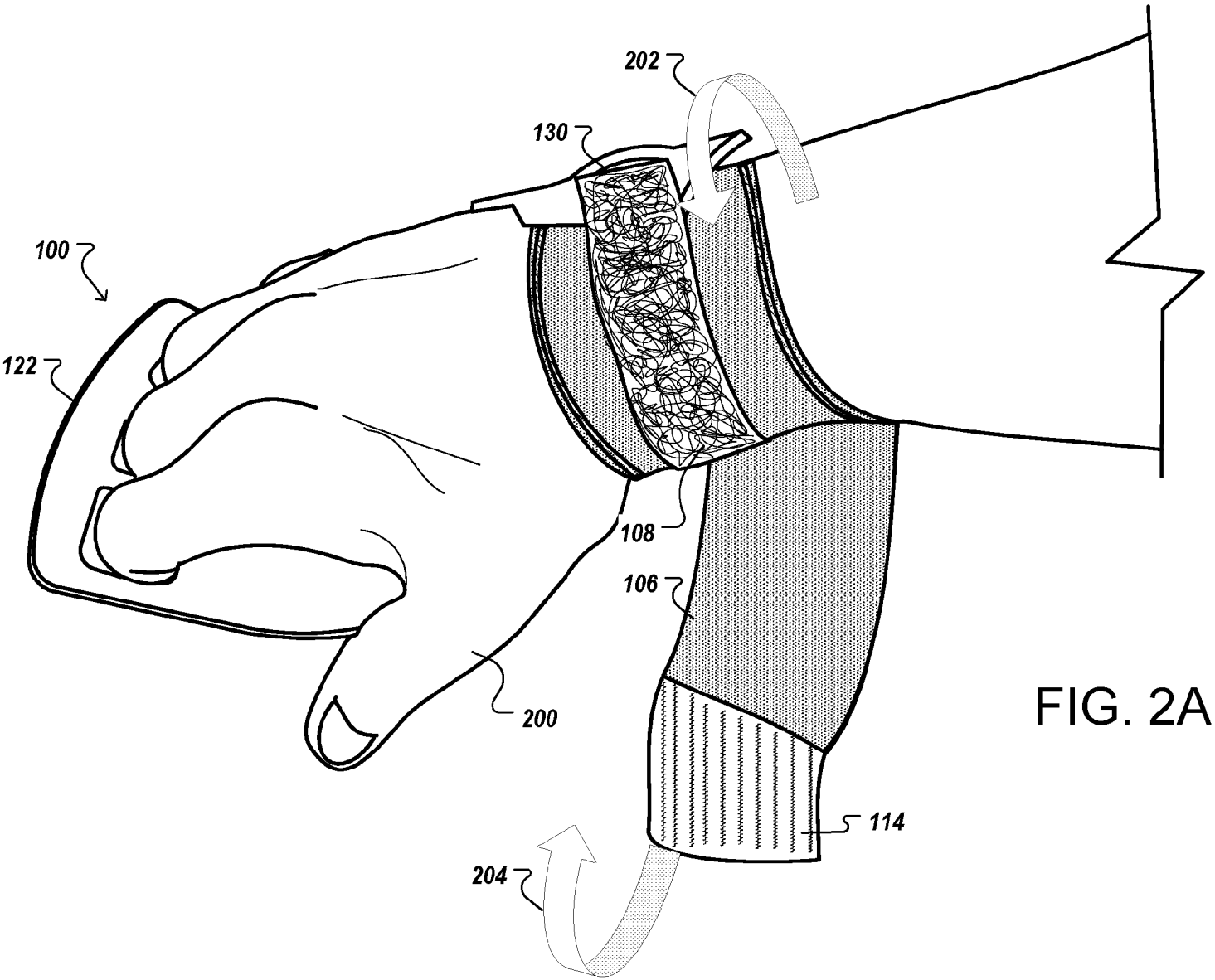
FIG. 2A is another illustration of the grip, as worn on a hand.
Figure 2B:
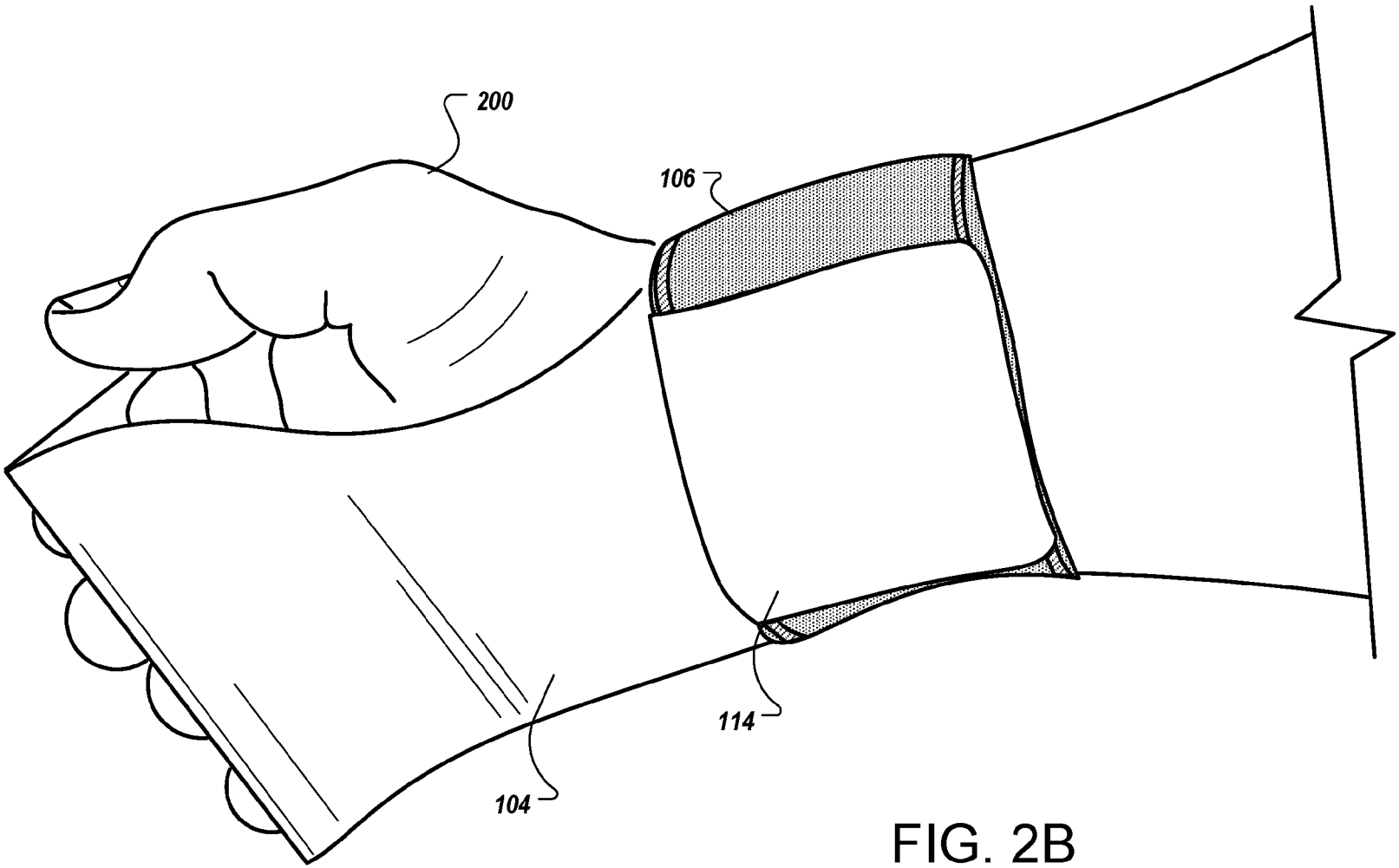
FIG. 2B is another illustration of the grip, as worn on a hand.

FIG. 2A is another illustration of the example grip 100, as worn on a hand 200. FIG. 2A highlights the way that the wrist strap 102 is wrapped around the wrist so that the inelastic material 108 can be fed through the wrist strap hole 130 and wrapped back in the opposite direction to secure the inelastic material 108 to the elastic material 106, as illustrated by the arrow 202. In other words, the inelastic material 108 is fed through the wrist strap hole 130 from underneath the current view. The inelastic material 108 is the pulled through the wrist strap hole 130, and then pulled back in the opposite direction to secure the inelastic material to the elastic material 106 (e.g., by way of the loop and/or hook material). Once the inelastic material 108 is secured, the remaining portion of the elastic material 106 can be wrapped around the wrist in the opposite direction (e.g., as illustrated by the arrow 204) and secured to itself using the fastener section 114 (e.g., by way of the hook and/or loop material), as shown in FIG. 2B. Note that in FIG. 2B, the fastener material is illustrated without fill, indicating that the surface of the fastener material shown does not include hook or loop material.

Figure 3:
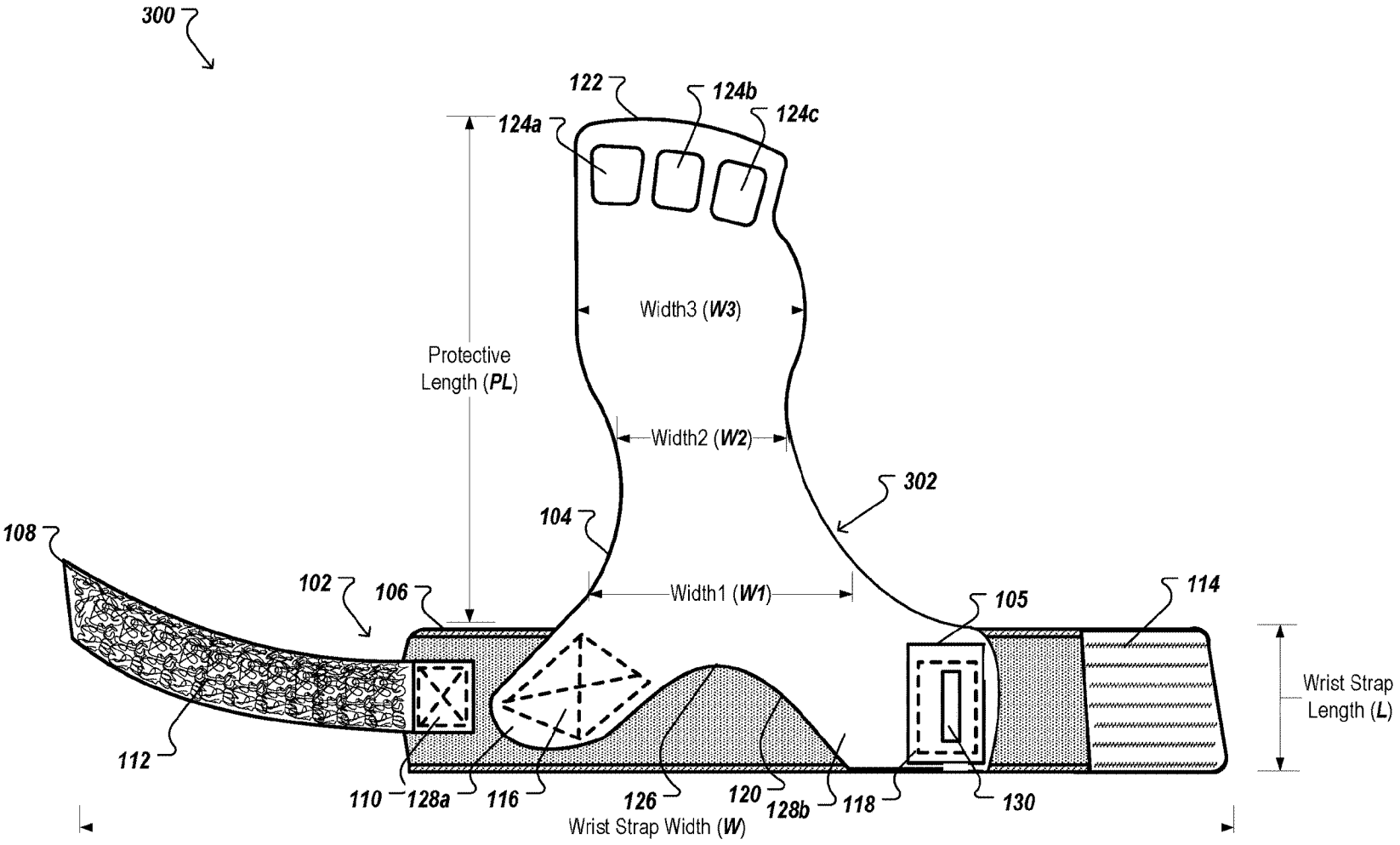
FIG. 3 is an illustration of another grip laid flat.

FIG. 3 is an example illustration of another grip 300. This grip 300 is substantially the same as the grip 100 discussed above, as shown by the use of the reference numbers lxx, but the grip 300 has an edge 302 that differs slightly in shape relative to the corresponding edge of the grip 100. The exact shape of this edge 302 can vary depending on various factors, such as comfort, durability, and/or other reasons.

Figure 4:
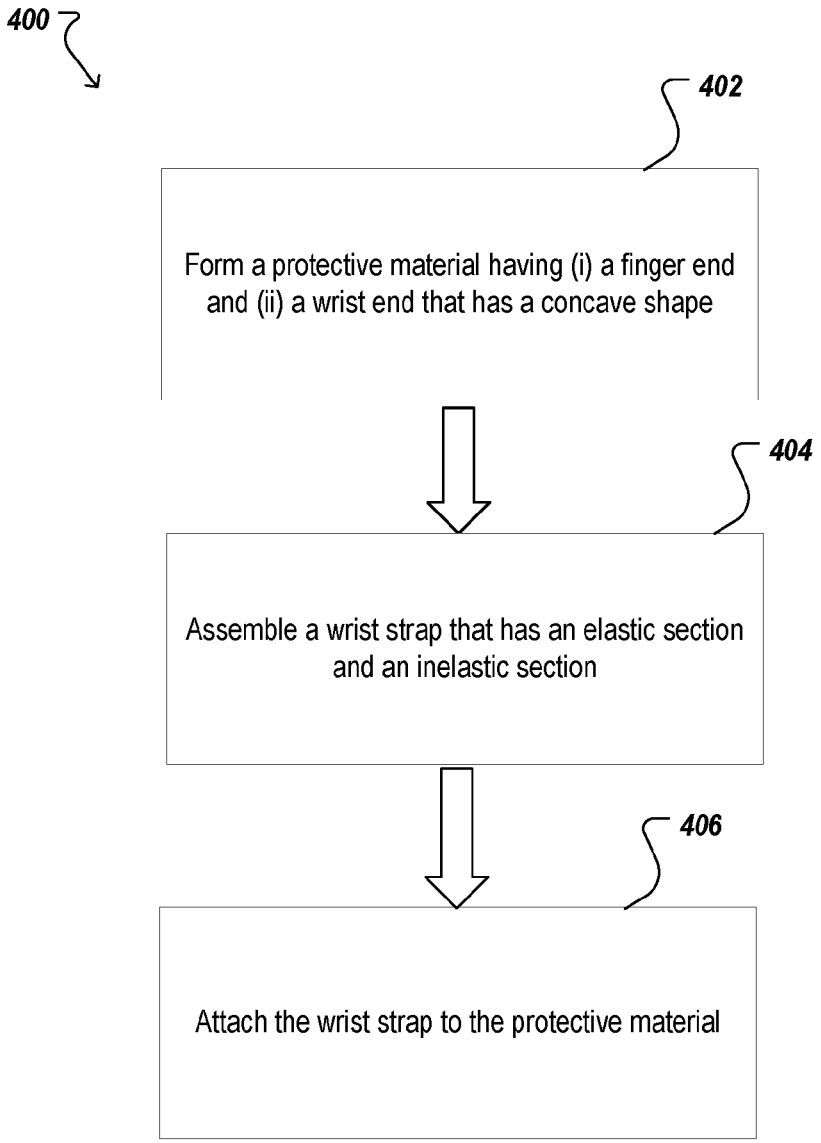
FIG. 4 is a flow chart of an example method for creating a grip.

FIG. 4 is a flow chart of an example process 400 for creating a grip. The process 400 can be used to manufacture or otherwise create the grips discussed throughout this specification.

A protective material is formed (402). The protective material, which is also referred to as a palm protection area, is configured to cover at least a portion of a palm of a hand wearing the grip. The protective material is formed to have a wrist end, a finger end, and sides that extend from the finger end to the wrist end.

In some implementations, the wrist end of the grip is formed to have a concave shape. More specifically, the concave shape of the edge of the wrist end is between the sides of the protective material that extend from the wrist end and the finger end. It is not necessary for the entire edge of the wrist end to form a concave shape. Rather, only a portion of the wrist end edge needs to have a concave shape, as shown in FIGS. 1A-3. The concave shape of the protective material at the wrist end defines at least two legs on opposite sides of the apex of the concave shape, as shown in FIGS. 1A-3. The concave shape can define, or be defined by, an arched void, a semicircle void, or an angled void at the wrist end of the protective material.

In some implementations, the protective material (palm protection area) has a non-woven composite material that is exposed on a first face (palm face) of the palm protection area and a synthetic rubber material that is exposed on a second opposite face of the protective material (e.g., a bar-facing surface). The first face of the palm protection area faces the palm of the hand wearing the grip. The second opposite face of the palm protection area faces away from the palm of the hand wearing the hand covering.

The protective material can be formed from a first layer of the synthetic rubber material that is spread over the non-woven composite and a second layer of the synthetic rubber material applied to the first layer of the synthetic rubber material. The non-woven material can be made of nylon and poly-paraphenylene terephthalamide. A bonding layer can be applied to the non-woven composite, and the bonding layer can include polyurethane or acrylic.

The formation of the protective material can include forming a wrist strap hole in one of the legs of the wrist end. The wrist strap hole can be defined in the opposite leg than the anchor location (discussed below), e.g., a leg that is on an opposite side of the apex of the convex shape than the anchor location.

In some implementations, the protective material can be formed to have different widths at different locations along an axis that extends between (and passes through) the wrist end and the finger end of the protective material. For example, the protective material can be formed so that the width of the protective material varies along a protective length (PL) of the protective material, as discussed in detail with reference to FIG. 1A.

The finger end of the protective material can have zero finger holes defined therein, thereby creating a "fingerless" grip. Alternatively, the finger end of the protective material can be formed to have two, three, or four finger holes. The finger holes are defined through a plane formed by the protective material when the protective material is laid flat. The finger holes can be defined by cutting, punching out, or otherwise penetrating the protective material to remove portions of the protective material at locations that are closer to the finger end than the wrist end.

A wrist strap is assembled (402). In some implementations, the wrist strap is assembled using multiple different materials. For example, the wrist strap can have an elastic section and an inelastic section. The elastic section can be formed using a portion of elastic material, and the inelastic section can be formed using a portion of inelastic material (e.g., a hook portion of hook and loop material). The inelastic section can be secured to a side of the elastic section that will be more proximate to an anchor location (discussed below) than the opposite side of the elastic section when the wrist strap is attached to the protective material. The elastic section and the inelastic section can be secured to each other, for example, by sewing the elastic section and the inelastic section together. Of course, other appropriate ways of securing the two sections together can be used. The location at which the elastic section and the inelastic section are joined/connected is referred to as a wrist strap junction.

The assembly of the wrist strap can include securing a fastener section to the elastic material. The fastener section can be, for example, a hook portion of a hook and loop material. The fastener section can be secured to the elastic section, for example, by sewing the fastener section to the elastic material. The fastener section can be secured to an end of the elastic section that is farthest away from the wrist strap junction. Of course, other appropriate ways of securing the two sections together can be used.

The wrist strap is attached to the protective material (406). The wrist strap can be attached, or otherwise secured, to the protective material at the anchor location. As discussed above, the anchor location is in one of the at least two legs of the wrist end of the protective material. For example, the anchor location can be in the leg that does not have the wrist strap hole defined therein. In other words, the anchor location can be in the leg that is on the opposite side of the apex of the concave shape of the wrist end relative to the leg in which the wrist strap hole is defined. In some implementations, the elastic section of the wrist strap is attached to the wrist end of the protective material at the anchor location.

Figure 5A:
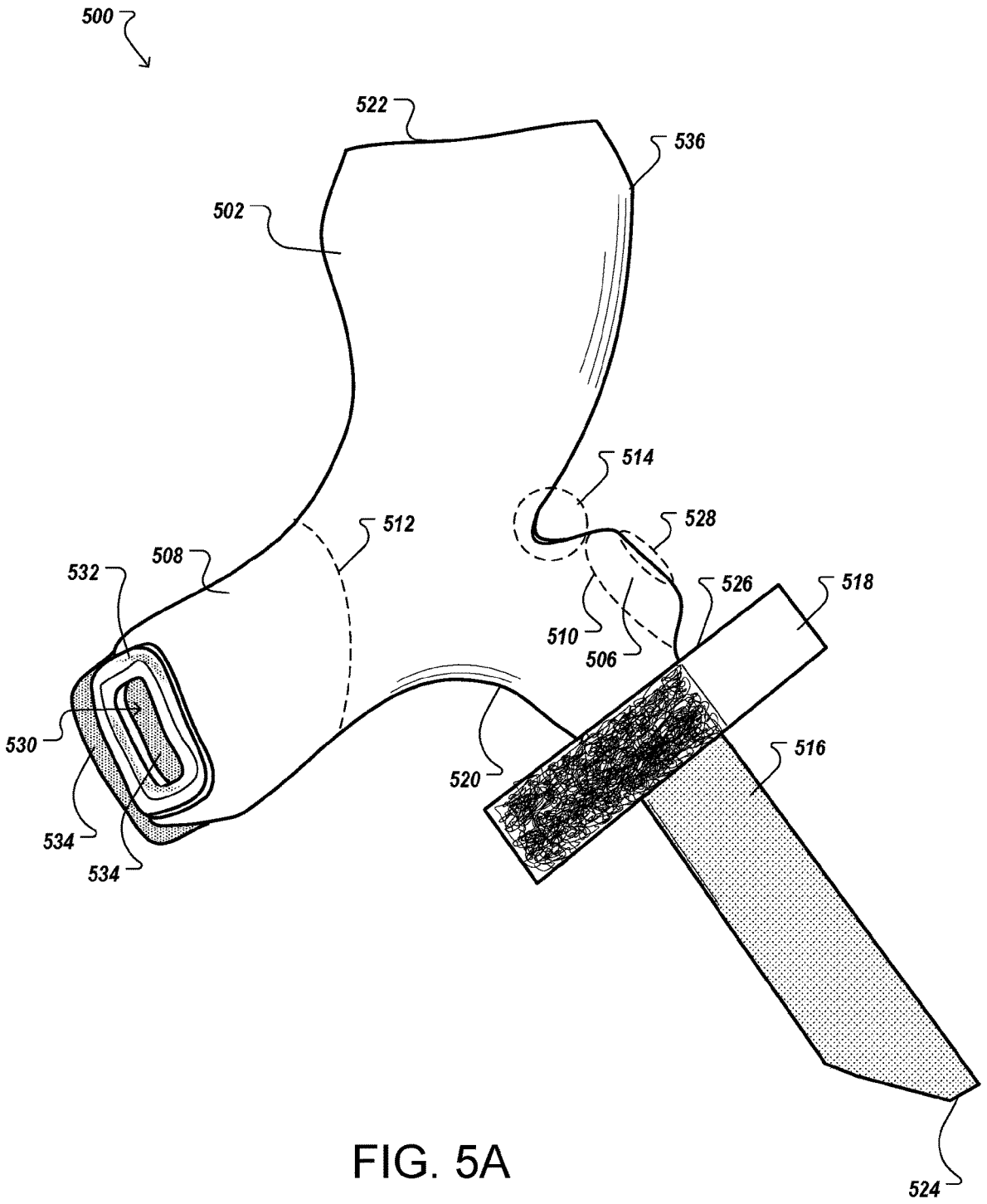
FIGS. 5A and 5B are illustrations of an example grip laid flat.
Figure 5B:
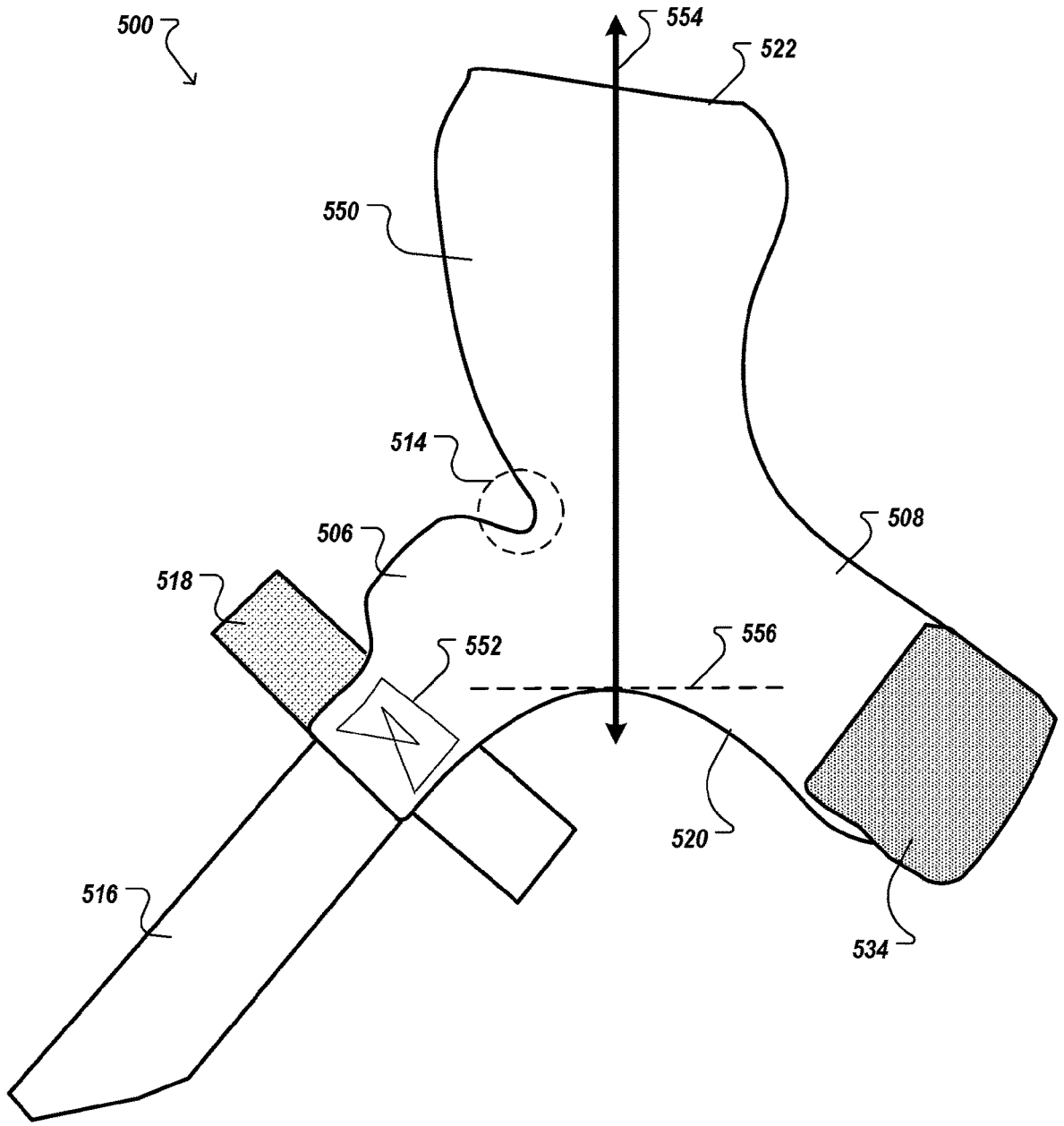

FIG. 5A is an illustration of an example grip 500 laid flat. The surface 502 (or face) of a material (e.g., protective material) of the grip 500 shown in FIG. 5A is the surface of the grip 500 that faces away from a palm of the hand when the grip 500 is worn. For example, the surface 502 can engage a bar when the grip is worn by a person doing gymnastics on a bar. The surface 502 has a wrist end 520 and a finger end 522. The grip 500 shown in FIGS. 5A and 5B is configured to be worn on an athlete's right hand.

Figure 9:
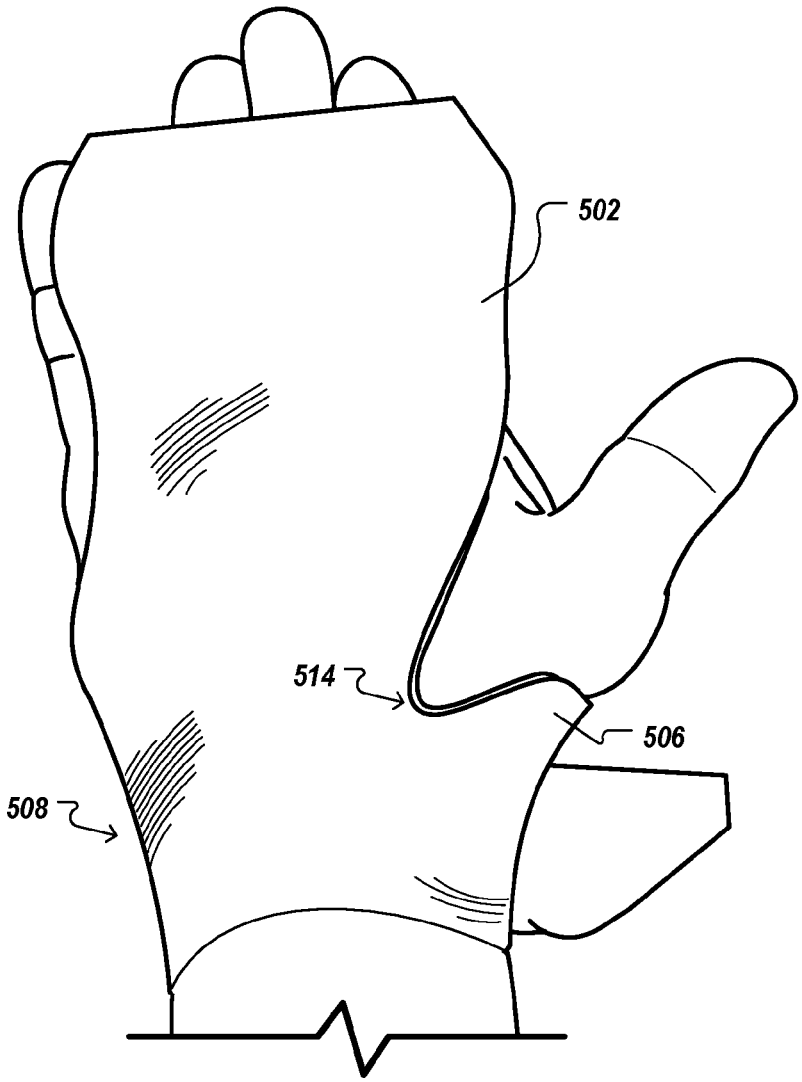
FIG. 9 is a palm view of the example grip secured to a wrist.

The grip 500 includes a thumb guard 506 and a wrist guard 508. The thumb guard 506 is formed on an opposite side of the grip 500 than the wrist guard 508. For example, as shown in FIG. 5A, the thumb guard 506 is formed on the right side of the surface 502, while the wrist guard 508 is formed on the left side of the surface 502. The thumb guard 506 is configured/formed to cradle the underside of the thumb when the grip 500 is worn by a person, as shown in FIG. 9. The wrist guard 508 is configured/formed to wrap around an ulnar side of a person's hand/wrist when the grip 500 is worn to protect the user's hand/wrist when doing gymnastics movements, such as a false grip ring muscle up, where the side of the person's wrist/hand comes into contact with gymnastics rings. Note that dashed lines 510 and 512 are used to visually distinguish the thumb guard 506 and the wrist guard 508 from the rest of the surface 502, but these dashed lines do not define the exact locations where the thumb guard 506 and wrist guard 508 are located.

The grip 500 also has a cutout 514 that is on a same side of the surface 502 as the thumb guard 506 and located between the finger end 522 and the thumb guard 506. This cutout 514 provides better mobility/articulation of the thumb joint of a hand as compared to grips that do not include the cutout 514. As shown, the cutout 514 has an angle of less than 90 degrees, and has a concave shape relative to the side of the surface 502 that is between the cutout 514 and the finger end 522 (e.g., the side that connects a deepest part of the cutout 514 and the finger end 522).

The thumb guard 506 can have the shape of a plateau that is elevated relative to the deepest part of the cutout 514 (e.g., at the inflection point of the cutout) and the location of the surface 502 that intersects a side 526 of the secondary enclosure 518 that is closest to the cutout 514. For example, each side of the thumb guard 506 can be connected to a relatively flat portion 528 of the thumb guard 506 by a transition angle that is greater than or equal to 90 degrees, which creates a transition from the relatively flat portion 528 of the thumb guard 506 and each of the cutout 514 and the portion of the surface 502 that intersects the side 526 of the secondary enclosure 518 that is closest to the cutout 514.

The grip 500 includes a primary enclosure 516 and a secondary enclosure 518. The primary enclosure 516 is generally oriented orthogonal to the secondary enclosure 518, but need not be oriented at 90 degrees relative to the secondary enclosure. Rather, the secondary enclosure 518 only needs to be oriented so that it can wrap around the primary enclosure 516 after the primary enclosure 516 is closed, as discussed in more detail with reference to FIGS. 8A and 8B. Generally speaking, the primary enclosure 516 and the secondary enclosure 518 can be arranged in a "T" configuration.

The secondary enclosure 518 is located closer to the thumb guard 506 than the primary enclosure 516, while the primary enclosure 518 can have a length that extends away from each of (i) the thumb guard 506 and (ii) the secondary enclosure 518 when the surface 502 is laid flat. As such, the secondary enclosure 518 is also located closer to the cutout 514 than the end 524 of the primary enclosure 516.

The side of the primary enclosure 516 shown in FIG. 5A can include a hook portion of a hook and loop fastener, while the side of the secondary enclosure 518 can include a loop portion of the hook and loop fastener. As illustrated, all of the primary enclosure 516 is shown as having the hook portion, but in some implementations, less than all of this side of the primary enclosure 516 can be covered by the hook portion. As illustrated, less than all of this side of the secondary enclosure 518 is shown as being covered by the loop portion, but in some implementations, all of this side of the secondary enclosure 518 could be covered with the loop portion of the hook and loop fastener. Note that the hook portions and loop portions could be swapped, such that this side of the primary enclosure 516 could have the loop portion, and this side of the secondary enclosure 518 could have the hook portion.

As discussed above, to more evenly distribute forces exerted on the wrist by the grip 500 when performing pulling movements (e.g., performing pull ups on a pull up bar), the edge of the wrist end 520 has a concave shape between the sides of the grip 500. For example, the concave shape can be defined between the thumb guard 506 and the wrist guard 508. The concave shape of the wrist end 520 is illustrated as defining, or being defined by, an arched void at the wrist end, such that the edge of the wrist end 520 forms a smooth curve, but the concave shape can be created/defined in other ways. For example, the concave shape can be created/defined using a semicircle void, an angled void, or another shape that creates a concave shape at the wrist end 520, as discussed above. The shape and functionality of the wrist end 520 is similar to that of the wrist end 120 discussed above, such that the description is not repeated here for brevity.

The left side of the grip 500 (e.g., the side of the wrist guard 508) has a primary enclosure receiving loop 530. The primary enclosure receiving loop 530 can be created by defining a void through the surface 502 or attaching a ring to a side of the surface 502. As shown in FIG. 5A, the primary enclosure receiving loop 530 is created by defining a void through a portion of the surface 502 that is adjacent to, at an end of, and/or part of the wrist guard 508. The primary enclosure receiving loop 530 is surrounded by reinforcement material 532 that increases the strength of the primary enclosure receiving loop 530 to reduce the likelihood that the surface 502 will tear because of forces of the primary enclosure 516 pulling on the primary enclosure receiving loop 530.

The void defined through the surface 502 to create the primary enclosure receiving loop 530 is generally at least a size of the width (e.g., shorter dimension of a rectangle) and the thickness of the primary enclosure 516 so that the primary enclosure receiving loop 530 is configured to receive the primary enclosure 516. In other words, the primary enclosure receiving loop 530 is a size that enables the primary enclosure 516 to be fed through the primary enclosure receiving loop 530.

The grip 500 includes an enclosure padding 534 that protects the wrist/hand from friction that can be caused by the primary enclosure 516 rubbing against the skin when the grip 500 is worn on a wrist/hand. The enclosure padding is secured to a wrist/hand side surface (e.g., a backside of the grip 500 relative to the surface 502) that faces the wearer's hand/wrist when the grip 500 is worn. The padding generally protects a dorsal (i.e., backside) of the wearer's wrist/hand. The enclosure padding 534 can be sewn, or otherwise attached, to the grip 500, and can be any appropriate padded material. As shown, the enclosure padding 534 is visible through the primary enclosure receiving loop 530 when the grip 500 is laid flat, and is attached to the opposite side of the grip 500, as shown in FIG. 5A.

Regarding the overall shape of the grip 500 shown in FIG. 5A, the left side of the surface (e.g., the side on which the wrist protection 508 and the primary enclosure loop 520 are located), has arcs that form an S-shape, with a bottom half of the S-shape (e.g., the bottom arc of the S-shape that is closer to the wrist end 520) having a larger concave arc (e.g., an arc of a larger radius) than the convex arc that forms the top half of the S-shape (e.g., the top arc of the S-shape closer to the finger end 522). Of course, other specific geometries could be used. In some implementations, the concave arc of the left side of the grip 500 could continue all the way to the edge of the finger end 522, rather than transitioning to a convex arc before the edge of the finger end. The opposite side of the grip (e.g., the right side on which the cutout 514 is defined) has a convex shape between the inflection point of the cutout 514 and the edge of the finger end 522.

The width of the surface 502 (i.e., between left edge and right edge) becomes smaller (i.e., more narrow) from the location at which the surface 502 meets the side 526 of the secondary enclosure 518 to the inflection point of the cutout 514. In some implementations, the width of the surface 502 can continue to narrow from the inflection point of the cutout 514 to a narrowest part of the surface 502 that is located closer to the finger end 522 than the inflection point of the cutout 514. In these implementations, the width of the surface 502 will get wider between the narrowest part of the surface 502 and a finger end inflection point 536 that is closer to the edge of the finger end 522 than the narrowest part of the surface 502. Between the finger end inflection point 536 and the edge of the finger end 522, the surface 502 can again narrow.

In some implementations, the narrowest part of the surface 502 can be at (or begin at) the inflection point of the cutout 514, and the width of the surface 502 can remain constant or increase between the inflection point of the cutout 514 and the finger end 522. In some implementations, the surface 502 can narrow between the finger end inflection point 536 and the edge of the finger end 522.

Note that the grip 500 is shown without any finger holes, but that finger holes can be defined through the surface 502 as discussed above with reference to the grip 100.

FIG. 5B is an illustration of an opposite surface 550 of the example grip 500 laid flat. For example, the surface 550 is an opposing face of the grip 500 relative to the surface 502 shown in FIG. 5A. The surface 550 can face the user's hand when the grip 500 is worn. As shown, the thumb guard 506 and cutout 514 are on the left side of the surface 550, and the wrist guard 508 is on the right side of the surface 550. The enclosure padding 534 is shown more fully in this view of the grip 500, and is attached at an end portion (e.g., a leg) on the right side of the grip 500. The primary enclosure 516 and the secondary enclosure 518 are attached at a different end portion (e.g., a different leg) of the grip 500 than the enclosure padding 534, and on opposite sides of the apex of the arc defining the wrist end 520.

As shown the primary enclosure 516 and the secondary enclosure 518 are both connected using a same set of stitching 552. Of course, separate stitching could be used for the different enclosures. The side of the secondary enclosure 518 shown has a hook portion of a hook and loop fastener on a portion of the secondary fastener 518 that is on a same side of the primary enclosure 516 as the plateau of the thumb guard 506. The portion of the secondary enclosure 518 that is on an opposite side of the primary enclosure 516 is shown without any hook and loop fastener materials. Similarly, this side of the primary enclosure 516 is shown without any hook and loop fastener material. In some implementations, the locations of the hook and loop fastener portions can be adjusted. As discussed in more detail with reference to FIGS. 8A and 8B, the hook portion of the secondary enclosure 518 shown in FIG. 5B will engage with the loop portion of the secondary enclosure 518 that is shown in FIG. 5A to secure the primary enclosure 516.

The arrow 554 represents an axis that passes through a center of the edge of the finger end 522 and the inflection point (e.g., apex) of the arc defining the wrist end 520. In some implementations, aligning the center of the finger end 522 and the inflection point of the arc defining the wrist end 520 results in a more even distribution of force along the arc defining the wrist end 520 and/or the wrist of the user wearing the grip 500, thereby improving the durability of the grip 500 and the comfort of wearing the grip 500 as compared to grips that have a straight (e.g., non-arced) wrist end.

Figure 6A:
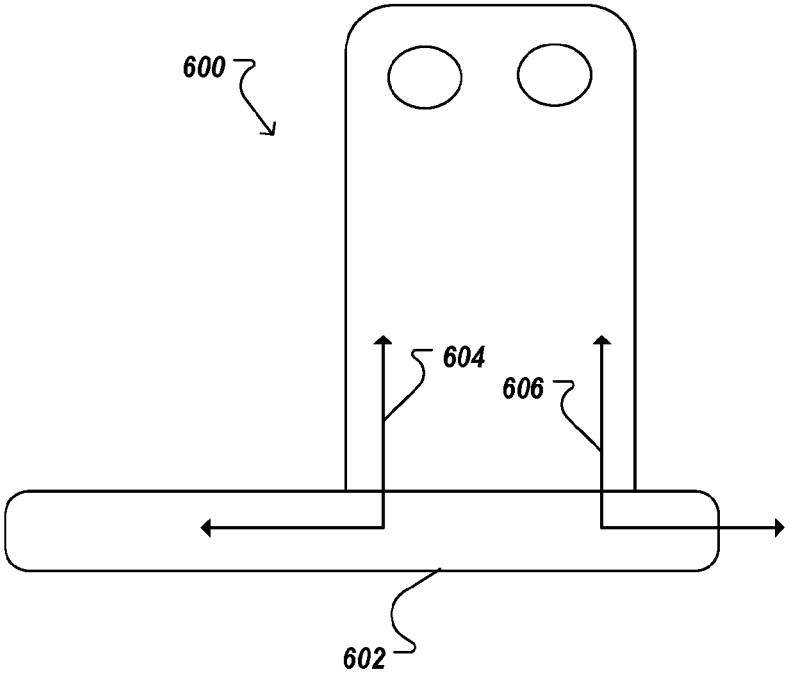
FIG. 6A is an illustration of a grip having a straight wrist end.
Figure 6B:
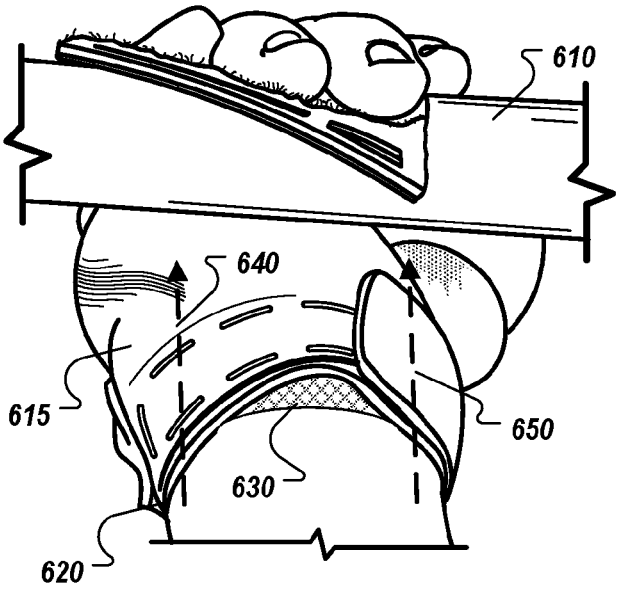
FIG. 6B is an illustration showing a straight wrist end of a grip on a wrist.

For example, FIG. 6A is an illustration of a grip 600 having a wrist end 602 that is straight rather than having an arc shape. When the wrist end 602 of the grip 600 is formed in this manner, the pulling forces are primarily focused in the areas shown by the arrows 604 and 606 (e.g., sides of the grip 600) because of the angle of the wrist end 602 as it relates to the shape of a person's wrist/hand. For example, as shown by FIG. 6B, when a person is pulling on a bar 610 when wearing a grip 615 having a straight wrist end 620, the portion of the wrist end 620 that is in the middle of the palm side of the wrist pulls away from the wrist to create a gap 630 shown with crosshatch. As can be appreciated, the portions of the grip 606 that are still in contact with the wrist (i.e., not separated from the wrist by the gap), will absorb the bulk of the pulling force, as shown by the dashed arrows 640 and 650, as will the portions of the wrist that are in contact with those portions of the grip 606. This leads to greater wear and tear on the wrist end 620 of the grip 606, which can result in the grip tearing more quickly. This also leads to discomfort to the portions of the wrist that remain in contact with the wrist end 620 on opposite sides of the gap 630.

In some implementations, the center of the edge of the finger end 522 and the inflection point of the arc defining the wrist end 520 need not be aligned. As used herein, the center of the finger end 522 and the inflection point of the wrist end 520 can be achieved by forming these portions of the grip 500 on an axis that is ninety degrees relative to the tangent 556 of the arc defining the finger end 520.

Figure 7:
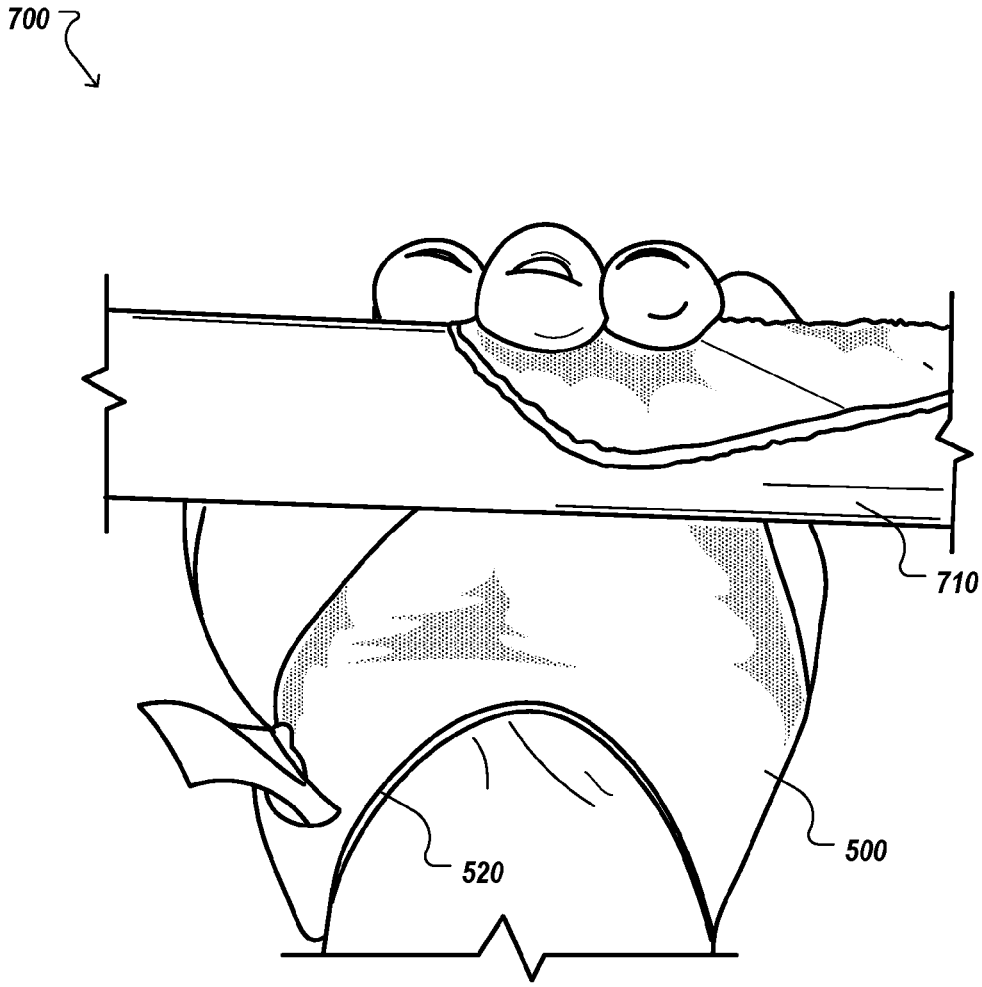
FIG. 7 is an illustration showing the wrist end of the example grip with an arc-shaped wrist end secured to a wrist.

In contrast, FIG. 7 is an illustration 700 of the grip 500 having the arc-shaped wrist end 520. In this illustration 700, the radius of the arc-shaped wrist end 520 results in more of (e.g., all of) the wrist end 520 of the grip 500 remaining in contact with the wrist when the user hangs on a bar 710 while wearing the grip 500. In other words, the force placed on the wrist end 520 of the grip 500 does not cause a gap to be created between the grip 500 and the wrist/hand of the person wearing the grip 500. As such, the pulling force on the wrist end 520 of the grip 500 is dispersed along the entirety of the wrist end 520, which leads to increased durability and more comfort to the person wearing the grip 500.

Figure 8A:
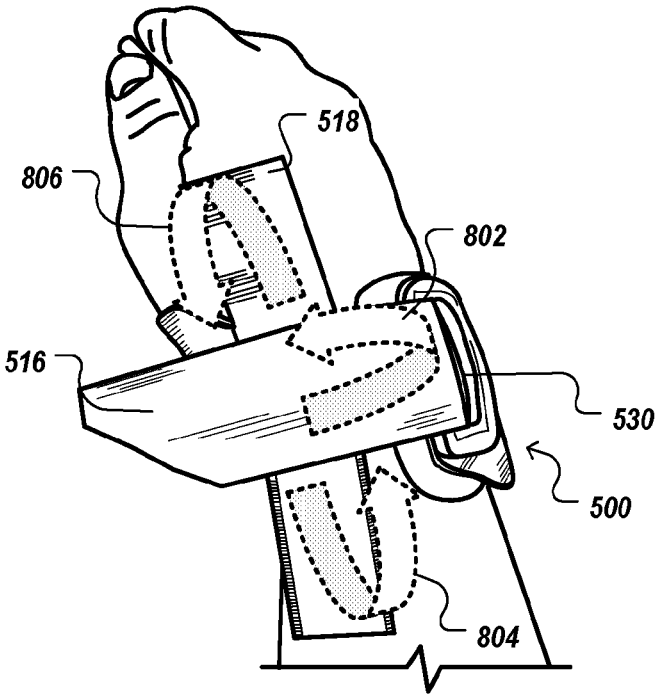
FIGS. 8A and 8B are illustrations of the example grip being secured to a wrist.
Figure 8B:
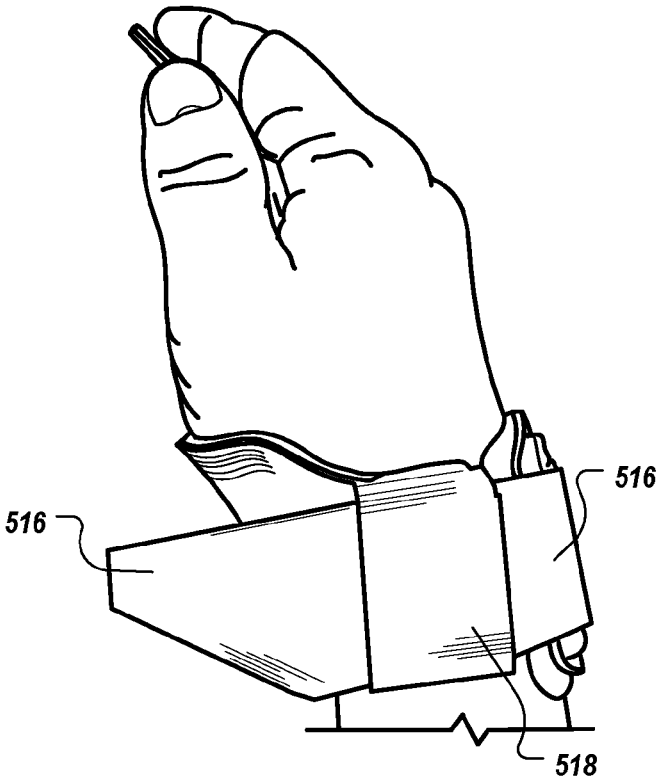

FIGS. 8A and 8B are illustrations showing how the primary enclosure 516 and the secondary enclosure 518 are used together to secure the grip 500 to a person's wrist. For example, as shown by the curved arrow 802 in FIG. 8A, the grip 500 can initially be secured to the person's wrist by passing the primary enclosure 516 through the primary enclosure loop 530, and securing the hook material of the primary enclosure 516 (e.g., as shown in FIG. 5A), to the loop material of the secondary enclosure 518 (e.g., as shown in FIG. 5A). FIG. 8A shows the orientation of the primary enclosure 516 relative to the secondary enclosure 518 after securing the hook material of the primary enclosure 516 to the loop material of the secondary enclosure 518.

After the primary enclosure 516 has been secured to the secondary enclosure 518, the secondary enclosure 518 can be closed around the primary enclosure 516 to reinforce the engagement between the primary enclosure 516 and the secondary enclosure 518. For example, both sides of the secondary enclosure 518 shown in FIG. 8A can be folded over each other, as illustrated by the curved arrows 804 and 806 to secure one side of the secondary enclosure 518 to the other side of the secondary enclosure 518.

Figure 8C:
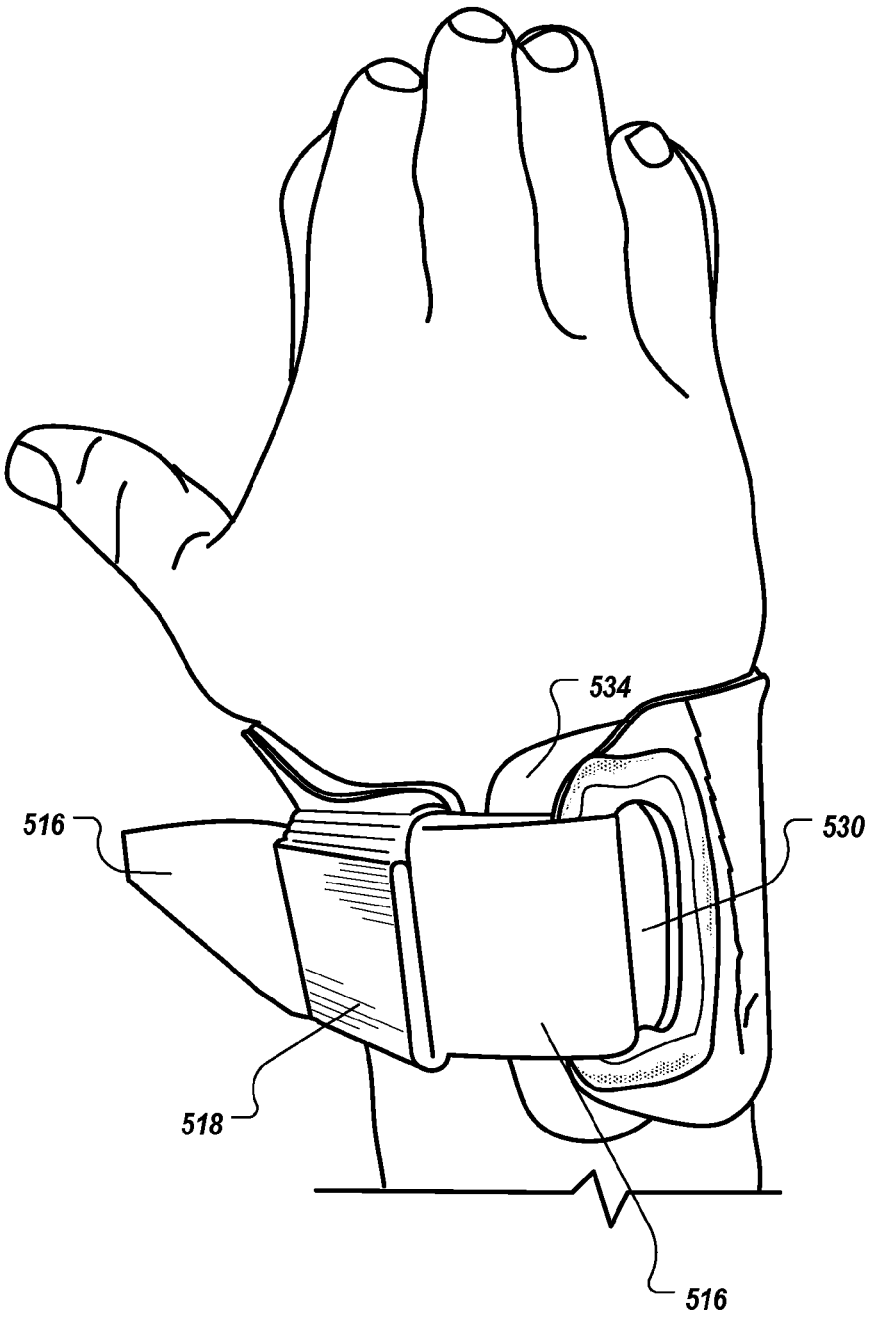
FIG. 8C is an illustration of a backhand view of the example grip secured on a wrist.

Each side of the secondary enclosure 518 that engages with the other side of the secondary enclosure can have one portion of hook and loop fastener so that the two sides of the secondary enclosure 518 remain engaged after being wrapped around the primary enclosure 516 and folded over each other. For example, as shown in FIG. 5A one side of the secondary enclosure can have the loop material extending to the end of the secondary enclosure 518. As shown in FIG. 5B, the other side of the secondary enclosure (e.g., on the opposite side of the primary enclosure) can have the hook material. As such, when the hook and loop materials that are on the opposite sides of the secondary enclosure 518 will engage when these opposite sides of the secondary enclosure are folded over each other in the manner illustrated by the curved arrows 804 and 806. The resulting engagement of the two sides of the secondary enclosure 518, as well as their relation to the primary enclosure 516 are shown in FIGS. 8B and 8C, and FIG. 8C shows the locations of the primary enclosure receiving loop 530 and the enclosure padding 534. As discussed above, engaging the primary enclosure 516 and secondary enclosure 518 in this manner can provide a more secure attachment to the person's wrist.

In some implementations, the wrist strap 102 discussed with reference to the grip 100 can be used with the grip 500. Additionally, or alternatively, some portions of the wrist strap 102 can be combined with the primary enclosure 516 and the secondary enclosure 518 to provide a more comfortable and/or more secure attachment to the person's wrist. For example, the elastic material 106 can be combined with the primary enclosure 516 and secondary enclosure 518 to provide for wrist support in addition to a secure attachment to the person's wrist.

Figure 10:
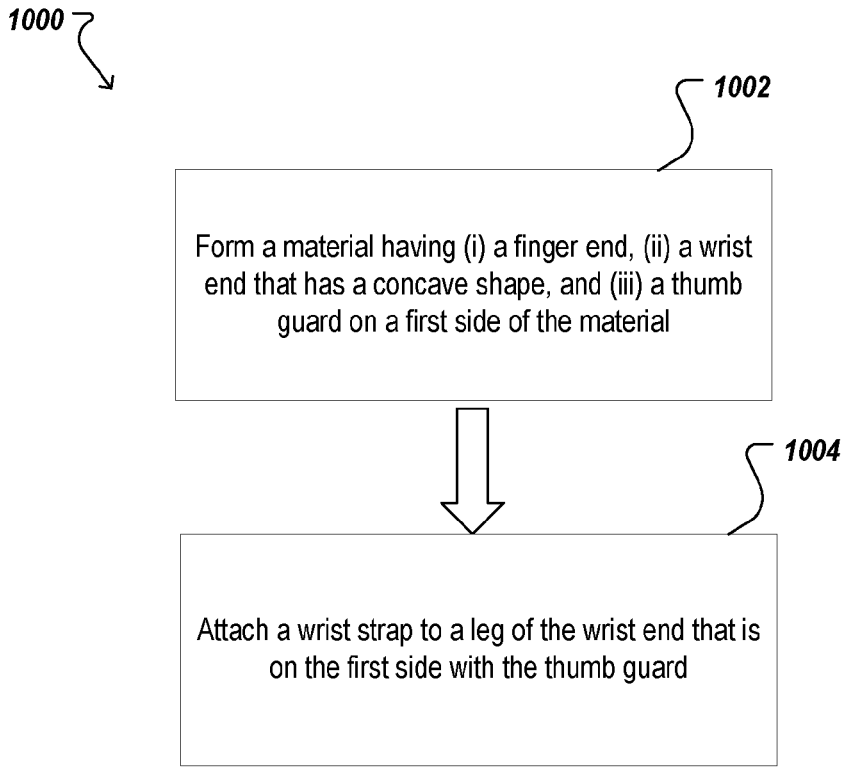
FIG. 10 is a flow chart of an example process of creating a grip.

FIG. 10 is a flow chart of an example process for creating a grip as discussed above. A material is formed to have (i) a finger end, (ii) a wrist end that has a concave shape, and (iii) a thumb guard on a first side of the material. The material is also formed to have sides that extend from the finger end to the wrist end. The wrist end of the material is formed to have a concave shape that (i) is between the sides of the protective material and (ii) defines at least two legs on opposite sides of an apex of the concave shape. In some implementations, the concave shape is formed as an arched void, a semicircle void, or an angled void at the wrist end of the material.

In some implementations, forming the material can include forming the first side of the material to have a cutout that is between the thumb guard and the finger end. The angle of the cutout can be less than 90 degrees. The thumb guard can be formed to have a shape of a plateau that is elevated relative to an inflection point of the cutout.

Forming the material can also include forming a wrist strap hole through a plane that is defined by the material when laid flat, the wrist strap hole being on the second side of the material. In other words, the wrist strap hole can be formed to go through the material, rather than being attached to the material. In some implementations, the wrist strap hole is located in a second leg of the material that is on an opposite side of the apex of the concave shape than the wrist strap and the thumb guard.

Forming the material can also include forming the material to have different widths at different locations along an axis that extends between the wrist end and the finger end. In other words, at different distances from the wrist end (or the finger end), the width of the material can vary, with the material being wider at some distances from the wrist end (or finger end) and narrower at other distances from the wrist end (or the finger end). Example width variations are shown throughout the figures previously discussed.

In some implementations, forming the material can include creating finger holes through a plane formed by the protective material laid flat. In other words, the finger holes go through the material, rather than glove fingers that extend away from or along a plane defined by the surface of the material that contacts a palm of the hand.

In some implementations, zero finger holes are created through the material, resulting in a "fingerless" grip.

A wrist strap is attached to a leg of the wrist end that is on the first side with the thumb guard (1004). The wrist strap can include a primary enclosure and a secondary enclosure, as discussed above with reference to FIGS. 5A, 5B, and 8A-8C. In some implementations, the primary enclosure and the secondary enclosure are arranged in a "T" configuration.

Figure 11A:
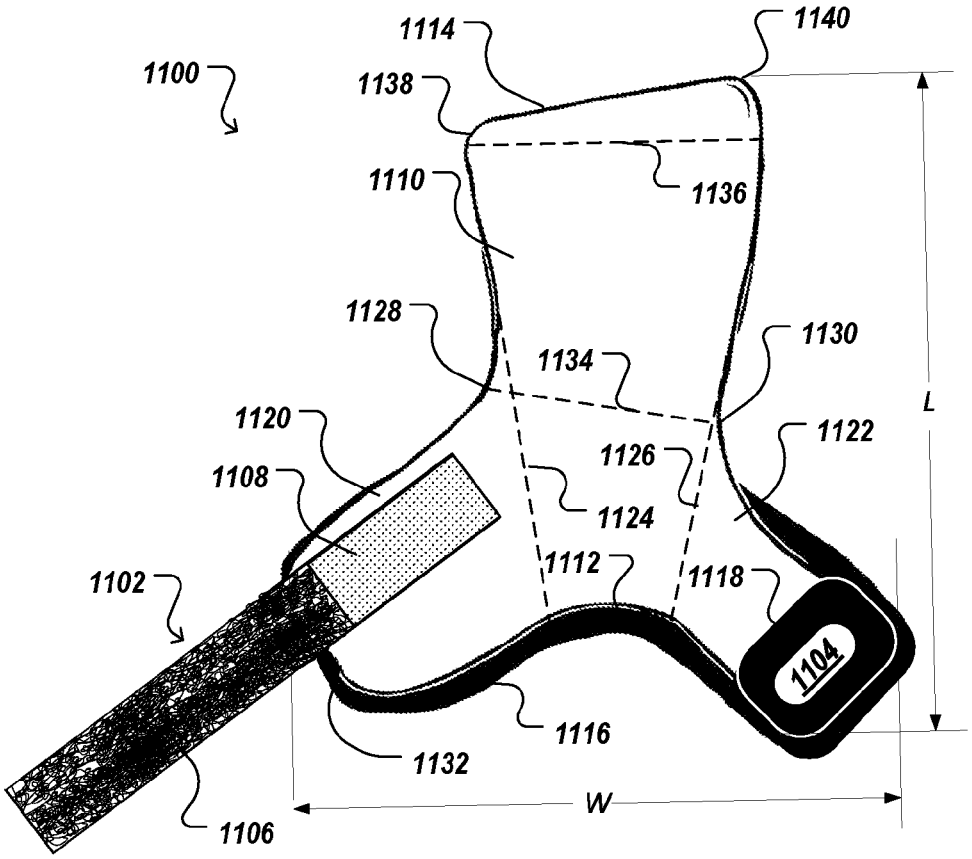
FIG. 11A is an illustration of another example grip laid flat.

FIG. 11A is an illustration of another example grip 1100 laid flat. Like the grips previously discussed, the grip 1100 has a wrist strap 1102. The wrist strap 1102 can be a generally rectangular portion of material that is configured to wrap around a wearer's wrist, be fed through a wrist strap hole 1104, and secured to another portion of the wrist strap 1100. For example, the wrist strap 1102 can be made of a fastener material, such as a hook and loop material (or other materials discussed throughout this specification). As illustrated, the wrist strap 1102 has a first section 1106 that is configured to be fed through the wrist strap hole 1104, wrapped back over, and fastened to a second section 1108 of the wrist strap 1102. In some implementations, the first section 1106 can be a hook (or loop) fastener, and the second section 1108 can be a loop (or hook) fastener.

Figure 13:
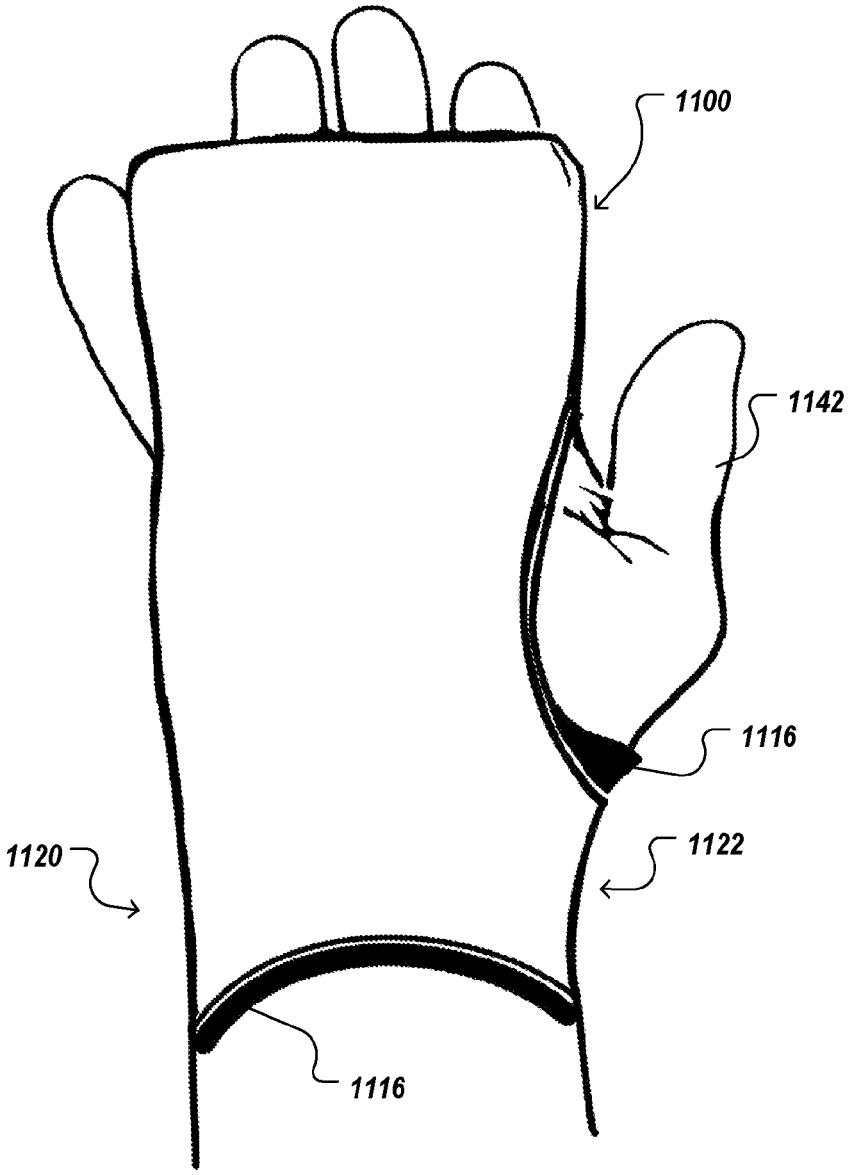
FIG. 13 is another illustration of the grip, as worn on a hand.
Figure 14:
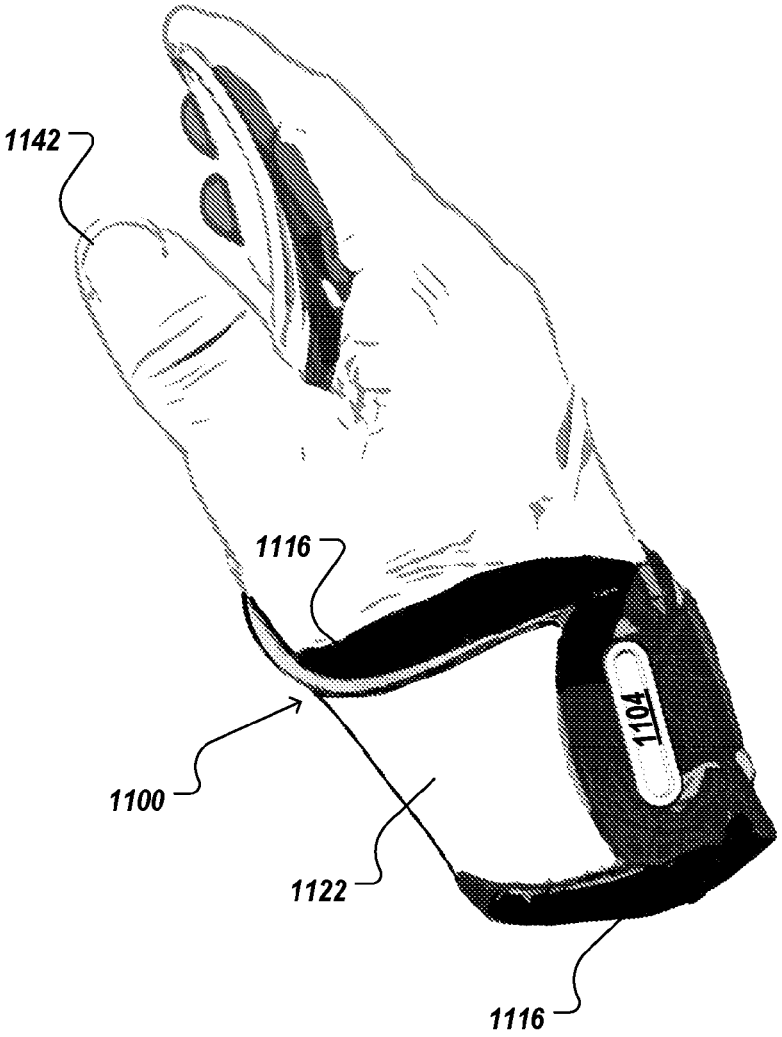
FIG. 14 is another illustration of the grip, as worn on a hand.
Figure 15:
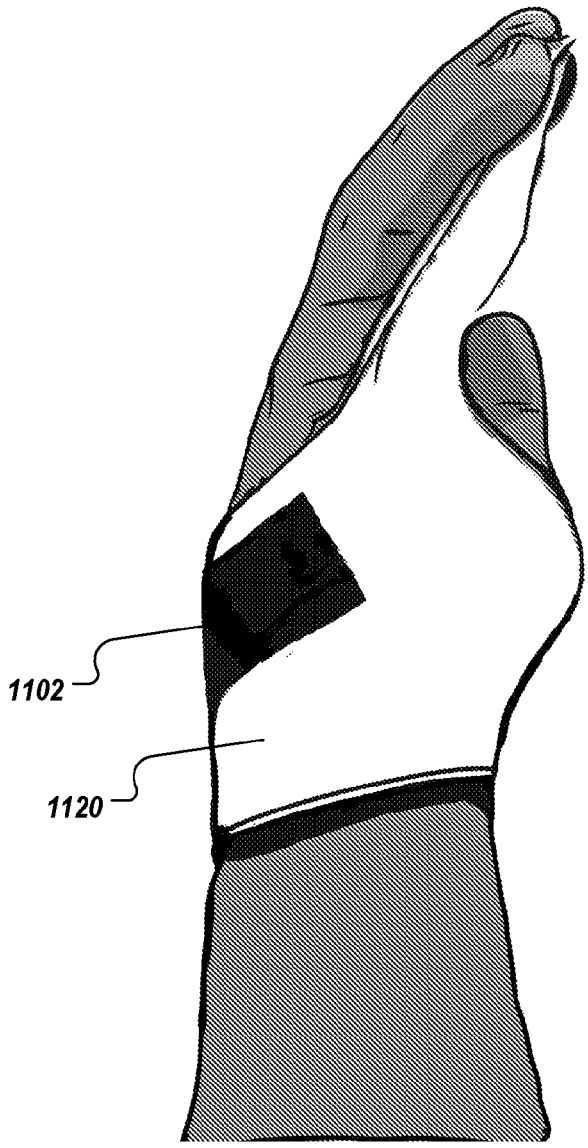
FIG. 15 is another illustration of the grip, as worn on a hand.

The wrist strap 1100 also includes a protective material 1110 that is configured to protect a palm of a wearer, for example, when the wearer performs gymnastics movements on a bar (e.g., pull ups) or on rings (e.g., ring muscle ups). The surface of the protective material 1110 shown is the surface that faces away from the wearer's palm when the grip 1100 is worn, as shown in FIGS. 13-15, and can be referred to as a "bar facing surface" because it is also the surface of the grip 1100 that engages a bar when the wearer grabs a bar.

The protective material 1110 has a wrist end 1112 and a finger end 1114. As discussed above, to more evenly distribute forces exerted on the wrist by the grip 1100 when performing pulling movements (e.g., performing pull ups on a pull up bar), the edge of the wrist end 1112 has a concave shape between the sides of the grip 1100. The concave shape of the wrist end 1112 is illustrated as defining, or being defined by, an arched void at the wrist end, such that the edge of the wrist end 1112 forms a smooth curve, but the concave shape can be created/defined in other ways. For example, the concave shape can be created/defined using a semicircle void, an angled void, or another shape that creates a concave shape at the wrist end 1112, as discussed above. The shape and functionality of the wrist end 1112 is similar to that of the wrist end 120 discussed above, such that the description is not repeated here for brevity.

The grip 1100 includes comfort padding 1116 that protects the wrist/hand from friction that can be caused by the protection material 1110 rubbing against the skin when the grip 1100 is worn on a wrist/hand. The comfort padding 1116 is secured to a wrist/hand side surface (e.g., a backside of the grip 1100 relative to the surface 1110 shown) that faces the wearer's hand/wrist when the grip 1110 is worn. The configuration of the comfort 1116 padding generally protects a dorsal (i.e., backside) of the wearer's wrist/hand, a portion of the wrist below the palm, as well as sides of the wrist of the wearer. The comfort padding 1116 can be sewn, or otherwise attached, to the grip 1100, and can be any appropriate padded material.

The comfort padding 1116 is also configured to protect the wearers hand/wrist from friction caused by the edges of the protective material 1110. For example, the comfort padding 1116 extends beyond the wrist end edges and lower outside edges (e.g., below a midway point of a maximum length L) of the protective material 1110 (e.g., excluding the comfort padding 1116).

The grip 1100 also includes a reinforcement element 1118 that is secured to the protective material 1110 at locations surrounding the wrist strap hole 1104, and is configured to reinforce (e.g., strengthen) the protective material 1110 that surrounds the wrist strap hole 1104. As shown, the reinforcement element 1118 is a separate piece of material than the protective material 1110, and sewn to the protective material 1110. Other techniques of forming the reinforcement element 1118 can be used, for example, as discussed with reference to FIGS. 1A and 5A.

As shown, the edge of the wrist end 1112 has a concave shape that is between two legs 1120 and 1122, which are visually identified using the dashed lines 1124 and 1126. The lines 1124 and 1126 are shown as continuations of the angles of the sides of the protective material 1110 that are closer to the finger end 1114 than the apexes 1128 and 1130 of the concave shapes of the sides. Of course, the legs could be delineated from a central portion of the protective material 1110 in other ways.

The legs 1120 and 1122 are portions of the protective material that are on opposite sides of the apex of the concave shape of the central portion of the wrist end 1112, and extend out beyond a widest width of the finger end 1114. In some implementations, the maximum width W between opposite sides of the protective material 1110 is measured between edges of the legs 1120 and 1122.

As shown, the leg 1120 is thicker than the leg 1122, such that the legs 1120 and 1122 are not symmetrical. Additionally, the wrist strap hole 1104 is defined in the thinner leg 1122, while the wrist strap 1102 is attached to the thicker leg 1120. The wrist strap 1120 is attached generally orthogonal to an end 1132 of the larger leg 1120, and intersects an axis defined by the tangent of the apex of the concave portion of the wrist end 1112. As shown, the apex of the concave portion of the wrist end 1112 is located within a central ⅓ of the width of the protective material 1110. As shown, the protective material 1110 resembles and upside down Y, with the edge of the finger end 114 being the bottom of the Y shape, and the legs 1120 and 1122 being the upper "arms" of the Y shape.

An axis 1134 passing through the apexes 1128 and 1130 of the concave portions of the sides of the protective material 1110 can be used as a reference point for delineating an upper portion of the protective material 1110 and a lower portion of the protective material 1110. The upper portion of the protective material 1110 is closer to (and includes) the edge of the finger end 1114 than the lower portion of the protective material 1110. A widest location of the upper portion of the protective material 1110, which is identified using the dashed line 1136, is between the axis 1134 and an apex of a convex arc 1138. The edge of the finger end 1114 extends from the apex 1138 of the convex arc and the apex 1140 of another convex arc that is on the opposite side of the edge of the finger end 1114. The shape of the protective material between the widest location of the upper portion and the edge of the finger end 1114 is a ramp shape, with the apex 1140 being further from an axis (e.g., 1136) passing through the widest location of the upper portion than the apex 1138.

Figure 11B:
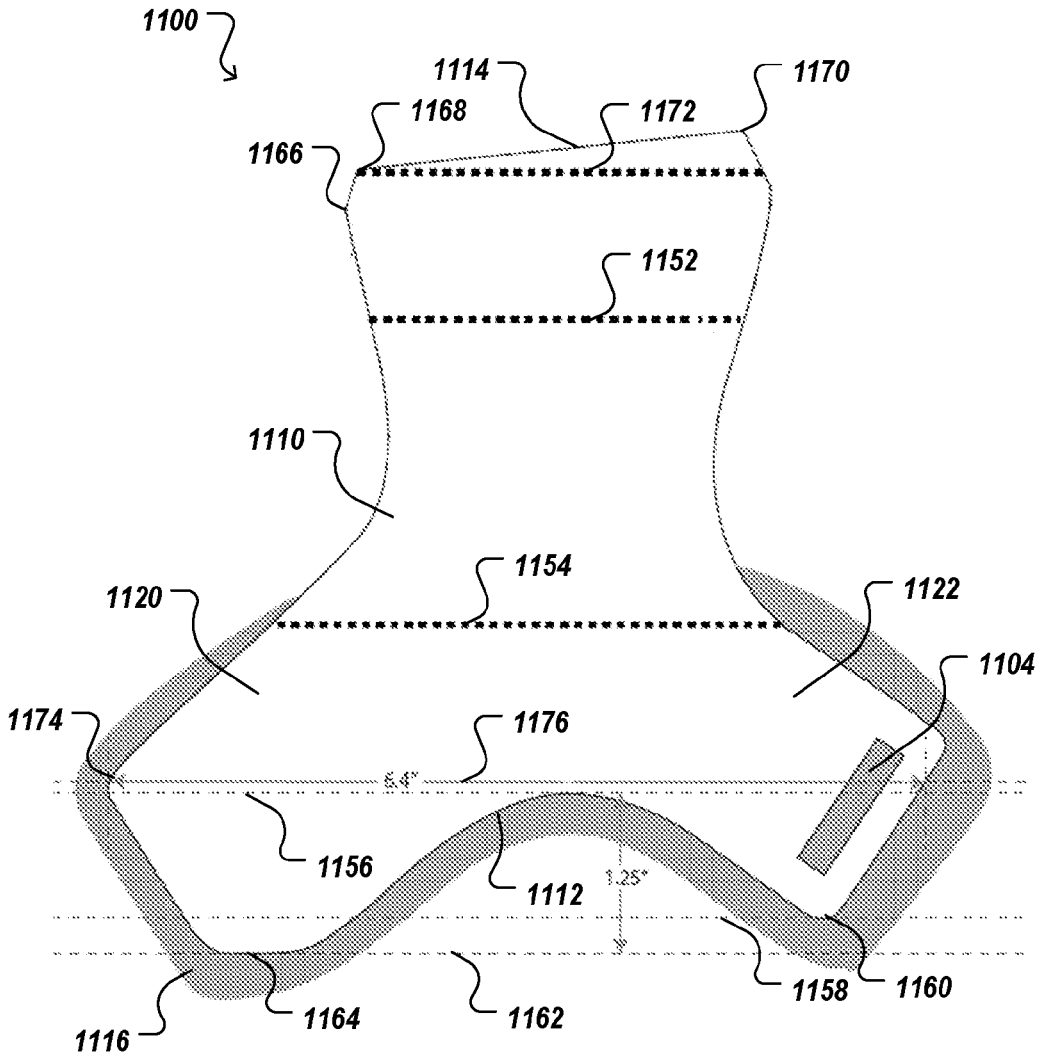
FIGS. 11B and 11C are design schematics for the example grip.
Figure 11C:
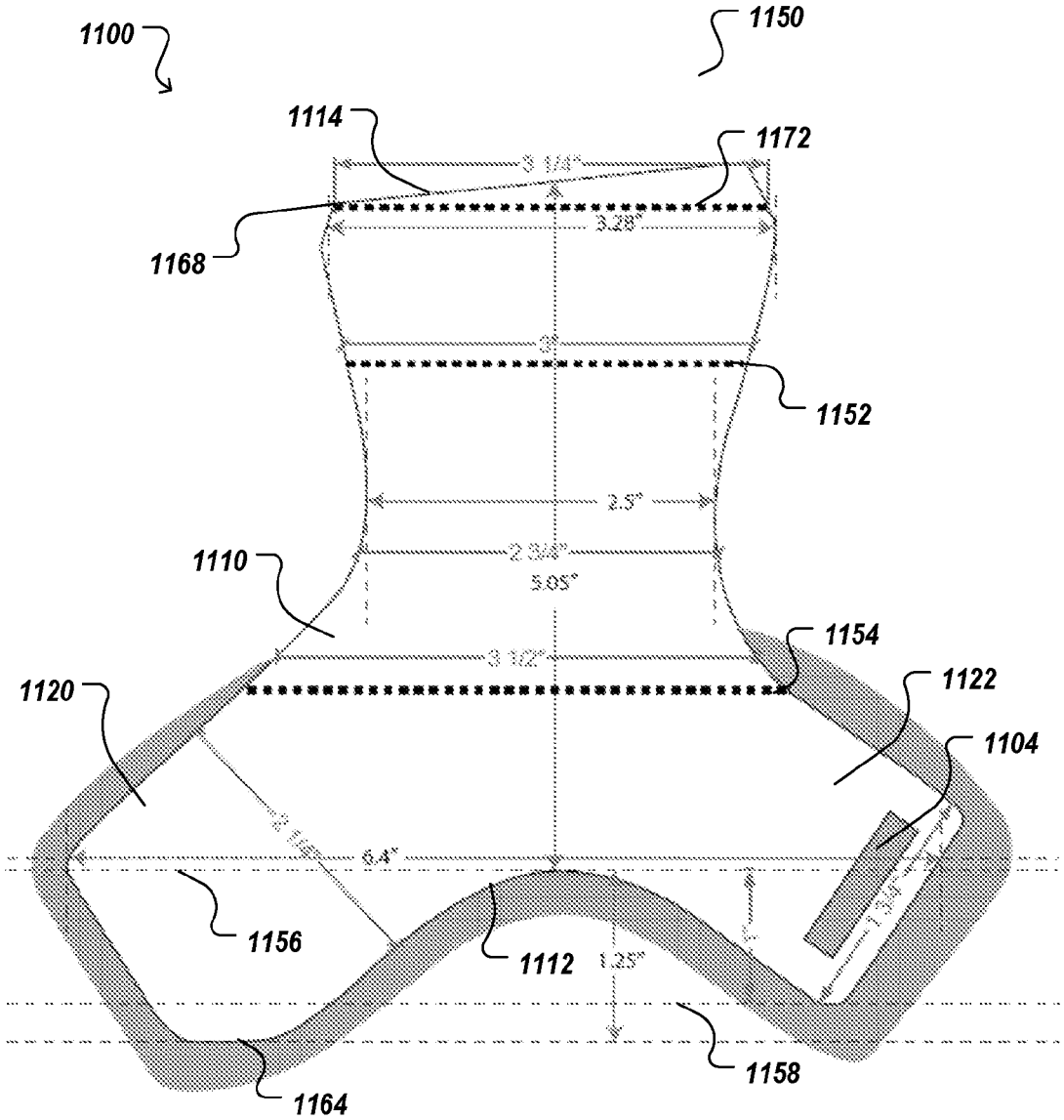

FIGS. 11B and 11C are design schematics for the example grip 1100. The illustration of IB shows two example dimensions of the example grip 1100. The dashed lines 1152 and 1154 respectively delineate a middle ⅓ section of the protective material 1110 of the grip 1100 from a top ⅓ section of the protective material 1110 of the grip 1100 and a bottom ⅓ section of the protective material 1110 of the grip 1100. The top ⅓ section of the protective material 1110 includes the finger end 1114, while the bottom ⅓ section of the protective material 1110 includes the wrist end 1112. The dashed line 1156 is tangential to the apex of the concave shape of the wrist end 1112, and the legs 1120 and 1122. The dashed line 1158 is parallel to the dashed line 1156 and is tangential to a bottom corner edge 1160 of the leg 1122 that is furthest from the finger end 1114. Meanwhile, the dashed line 1162 is parallel to the dashed line 1156 and is tangential to a bottom corner edge 1164 of the leg 1120 that is furthest from the finger end 1114.

In the top ⅓ section of the protective material 1110 of the grip 1100, the width of the grip 1100 increases until an inflection point 1166 (e.g., angle or apex of a curve) at which the width of the grip 1100 begins to decrease. As shown, the left edge (e.g., an edge furthest from the location of the wrist strap hole 1104 in this view) of the grip 1100 ends at another inflection point 1168 (e.g., angle point or apex of a curve), which begins the top edge of the finger end 1114. The top edge of the finger end extends at an angle away from the wrist end (e.g., the dashed line 1156), to a third inflection point 1170 where the edge of the finger end 1114 intersects the right edge (e.g., an edge closest to the wrist strap hole 1104) of the grip 1100. The dashed line 1172 is parallel to the dashed line 1156, and extends from the intersection point of the top edge of the finger end 1114 and the left edge of the grip 1100 to the right edge of the grip 1100.

In some implementations, the top edge of the finger end 1114 could be formed at the location of the dashed line 1172, thereby omitting the ramp shape of the finger end 1114 that extends beyond the dashed line 1172. Similarly, the top edge of the finger end 1114 could also be formed along a line that passes through the inflection point 1166 and extends to the right side of the grip 1100 on a path that is parallel to the dashed line 1156.

Some of the dimensions of the grip 1100 are shown in FIG. 11B. Note that dimensions of the grip 1100 can vary (e.g., when created in different sizes for different size hands), but the relative dimensions of the grip will be similar to those discussed herein to maintain the same overall shape and functionality of the grip. The dimensions provided are for purposes of illustration only, are not intended to limit the scope of the claims or this specification. As shown, the width of the grip between a most distal edge location of the left side of the grip 1174 (e.g., excluding the comfort pad) from the wrist strap hole 1104 and the opposite side edge of the grip 1100 is shown as being 6.4 inches, as illustrated by the measurement line 1176. Also, the measurement line 1178 shows that the distance between the line 1156 (e.g., tangent to the apex of the concave shape of the wrist end 1112) and the dashed line 1162 (tangential to a bottom corner edge 1164 of the leg 1120 and parallel to dashed line 1156) is 1.25 inches, such that the concave shape of the wrist end 1112 is 1.25 inches closer to the finger end (and the dashed line 1172) than the bottom edge of the leg 1120.

More dimensions of the grip 1100 are shown in FIG. 11C. As shown in this figure, The distance from the dashed line 1158 (tangential to the bottom corner edge 1160 of the leg 1122) to the dashed line 1156 is 1 inch, such that the bottom corner edge 1160 of the leg 1122 is ¼ inch closer to the line 1156 than the bottom corner edge 1164 of the leg 1120.

As shown, the width of the leg 1120 is 2¼ inches, while the width of the leg 1122 is 1⅝ inches, such that the leg 1120 is wider than the leg 1122. Meanwhile the width of the protective material in the middle ⅓ section of the protective material 1110 decreases from 3½ inches at location between the dashed line 1154 and the middle of the length of the grip to 2¾ inches, and again to 2½ inches, which is the narrowest portion of the middle ⅓ section of the protective material. The middle ⅓ of the protective material 1110 then becomes wider at locations closer to the finger end 1114. Within top ⅓ section of the protective material 1110, the grip continues to wide beyond 3 inches to at least 3.28 inches, and then narrows to 3¼ inches at the dashed line 1172, which is the location at which the top edge of the finger end 1114 intersects with the left side edge (e.g., opposite side from the wrist strap hole 1104) at the inflection point 1168. The length of the protective material is shown as being 5.05 inches, along a path that begins at the apex of the concave shape of the wrist end 1112 and is perpendicular to the dashed line 1156, which is tangent to the apex of the concave shape of the wrist end 1112. Again, the dimensions of the protective material 1110 can vary, and the dimensions provided herein are for purpose of illustration only, and to help convey the shape of the protective material 1110.

Figure 12:
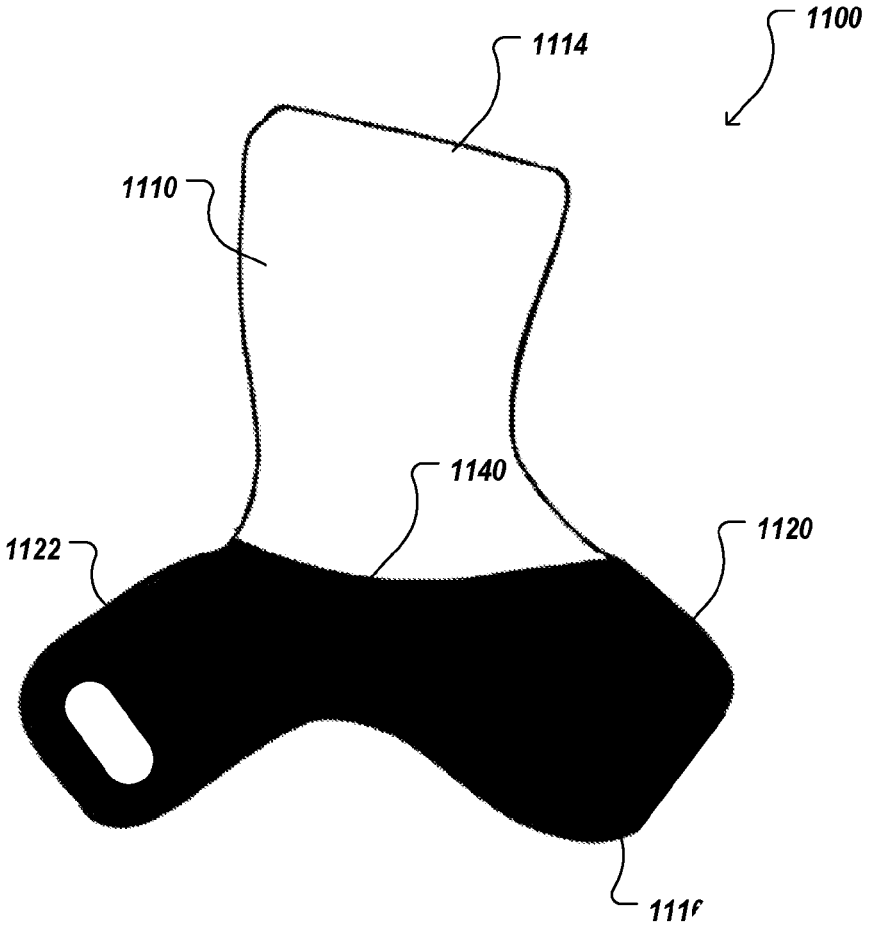
FIG. 12 is another illustration of the grip laid flat.

FIG. 12 is another illustration of the grip 1100 laid flat. The illustration in FIG. 12 is an opposite surface (e.g., a palm facing surface) of the grip 1100 than shown in FIG. 11A. In this view, the wrist strap has been omitted to focus on the arrangement of the comfort padding 1116 and the protective material 1110. In some implementations, the comfort padding 1116 is a different material than the protective material 1110. For example, the comfort padding 1116 can be neoprene or another material that provides padding. The comfort padding 1116 can have substantially the same shape as the legs 1120 and 1122 of the protective material 1110, and the edge of the wrist end 1112, which are all occluded from view by the comfort padding 1116. The numerical references are included for perspective. The edge 1140 of the comfort padding 1116 that is closest to the finger end 1114 can have a concave shape between the sides of the protective material 1110. Except for the edge 1140, the dimensions of the comfort padding 1116 are generally selected to be larger than the protective material 1110, which prevents edges of the protective material 1110 from rubbing against the wearer's skin, thereby preventing irritation to the skin. Note that similar comfort padding can be used with any of the other grips discussed herein, and that the shape of the comfort padding can be selected to match the shapes of the protective materials in a similar manner.

FIG. 13 is another illustration of the grip 1100, as worn on a hand. In this illustration, the surface of the protective material 1110 shown is the "bar facing" surface discussed above with reference to FIG. 11. As shown, the apex 1130 of the concave shape on the side of the wrist strap hole 1104 (not shown) is located near the wearer's thumb 1142. The leg 1122 is configured to wrap around the wearer's wrist on the thumb side of the wearer's hand, while the leg 1120 is configured to wrap around the opposite side (e.g., the ulnar side) of the wearer's wrist. The comfort padding 1116 is shown extending further down the wearer's wrist than the protective material 1110, which prevents the protective material 1110 from rubbing the wearer's wrist. Also, the comfort padding 1116 is shown protecting the wearers thumb from edges of the protective material 1110.

FIG. 14 is another illustration of the grip 1100, as worn on a hand. In this illustration, the location of the wrist strap hole 1104 and the leg 1122 are shown in more detail when the grip 1100 is worn. The comfort padding 1116 is again configured to be in contact with the wearer's wrist and thumb to prevent the protective material 1110 from rubbing the wearer's skin on the wrist or thumb. In some implementations, the comfort padding 1116 is considered a thumb guard due to the protection provided to the wearer's thumb.

FIG. 15 is another illustration of the grip 1100, as worn on a hand. This view shows the leg 1120 wrapped around the ulnar side (e.g., pinky side) of the wearer's hand and wrist. This view also shows the configuration and location of the wrist strap 1102 when the wrist strap is secured around a wrist.

Figure 16B:
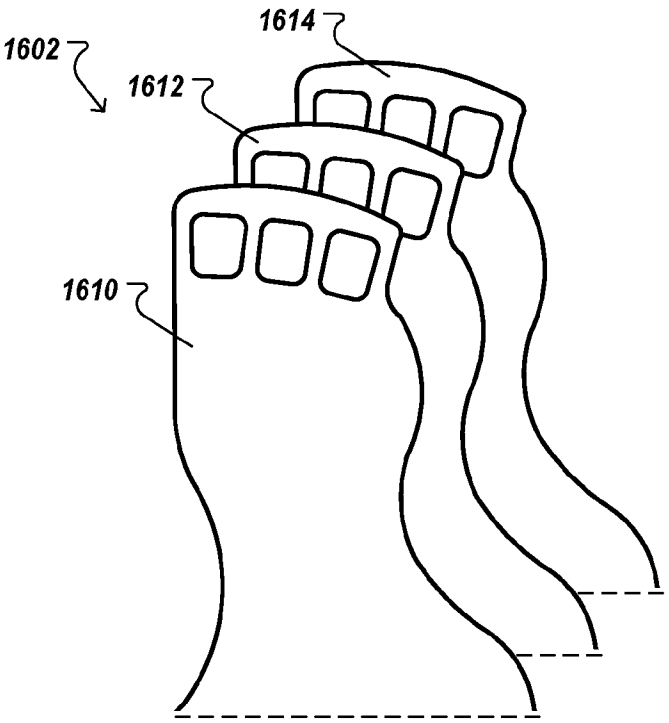
FIG. 16B is an exploded view showing example layers of the multi-layer material.
Figure 16A:
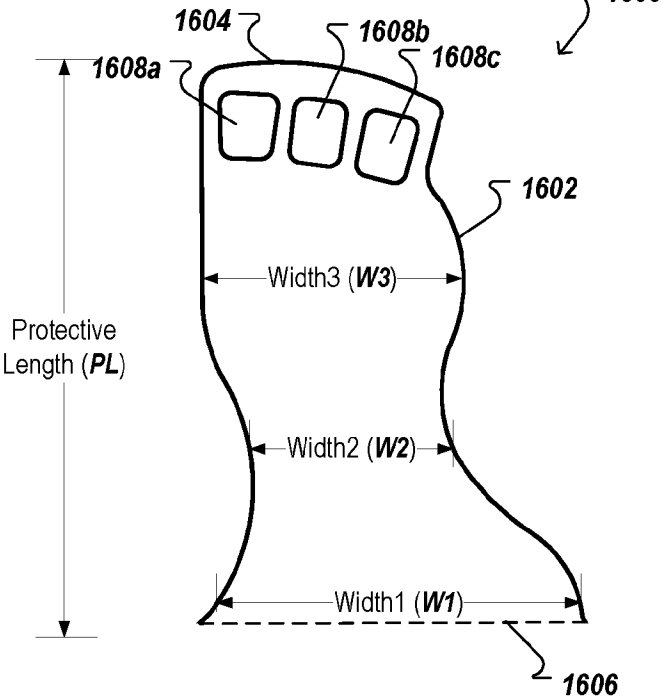
FIG. 16A is front view of a portion of a hand covering formed from a multi-layer material.

FIG. 16A is front view of a portion of a hand covering 1600 formed from a multi-layer material 1602. The hand covering 1600 is an example of a grip that can be formed using the multi-layer material 1602. The multi-layer material 1602 can have zero, one, two, three, four, or more finger holes defined therein, and the finger holes can be defined at a location of the multi-layer material 1602 that is closer to the finger end 104 than the wrist end 1606. The finger holes are created through a plane defined by the multi-layer material 1602 when the multi-layer material 1602 is laid flat. FIG. 16A shows an implementation having 3 finger holes 1608*a*, 1608*b*, and 1608*c* defined through the plane of the multi-layer material 102 that is laid flat.

In some implementations, the finger holes 1608*a*, 1608*b*, and 1608*c* can be omitted from the multi-layer material 1602 to form a "fingerless" version of the hand covering 1600 that is not worn over the fingers. Omitting the finger holes enables a quick transition from using the hand covering 1600 for gymnastics movements to not using the hand covering 1600, for example, when transitioning to perform non-gymnastics movements, without having to take the hand covering 1600 off of the fingers.

The width of the multi-layer material 1602 varies along a protective length (PL) of the protective material 1604. In other words, the multi-layer material 1602 has different widths at different locations along an axis that extends between (and passes through) the wrist end 1606 and the finger end 1604. For example, the multi-layer material 1602 has a first width (W1) at a first location that is between the wrist end 1606 and a narrowest portion of the multi-layer material 1602. The multi-layer material 1602 has a second width (W2) that is further away from the wrist end 106 than the first width (W1). As shown, the second width (W2) is smaller than the first width. The multi-layer material 1602 has a third width (W3) that is further away from the wrist end 1606 than the second width (W2). As shown, the third width (W3) is larger than the second width (W2). In some implementations, the third width (W3), which is closer to the finger end 1604 than either of the first width (W1) or the second width (W2), and is smaller than the first width (W1), which is closer to the wrist end 1620 than either of the second width (W2) or the third width (W3).

FIG. 16B is an exploded view showing example layers of the multi-layer material 1602. The example layers include a first layer 1610 that is made from a non-woven composite material. In some implementations, the non-woven composite material 1610 is a combination of nylon and poly-paraphenylene terephthalamide (e.g., KEVLAR®). A particular implementation of the first layer can be 90% nylon and 10% poly-paraphenylene terephthalamide. Different combinations of nylon and poly-paraphenylene terephthalamide can be used as appropriate for the application and/or to achieve a desired texture.

The multi-layer material 1602 can also include a second layer 1612 that is made from a rubber material. In some implementations the second layer 1612 is made from a synthetic rubber, such as Chlorosulfonated Polyethylene ("CSM"). CSM is resistant to chemicals, weathering, water, extreme temperatures, and exposure to UV light. When forming the multi-layer material 1602, the second layer 1612 can be pressed into the first layer 1610, so that the CSM penetrates one face of the non-woven material, while leaving the non-woven material exposed on the opposite face (e.g., the face of the first layer 1610 shown in FIG. 1B). This increases the durability of the non-woven material.

The multi-layer material 1602 can also include a third layer 1614 that is applied on top of the second layer 1612. In some implementations, the third layer 1614 can be made from the same synthetic rubber as the second layer 112. For example, a thicker layer (e.g., relative to the second layer 1612), of CSM can be applied on top of the second layer 1612 to provide additional durability of the multi-layer material 1602 for long-term use of the multi-layer material in high friction and/or high force applications. The third layer 1614 can be joined to the second layer 1612 by calendering the third layer 1614 to the second layer 1612. In the calendering process, generally, fabric and rubber or plastic material is passed through a series of rollers to flatten, smooth and commingle the two or more materials. In the present implementation, the two layers of CSM will be calendered together to increase the thickness of the CSM, while keeping the non-woven material exposed on the opposite face of the multi-layer material 1602.

The multi-layer material 1602 can also include other layers beyond those discussed. For example, a fourth layer (not shown) can be applied to the exposed non-woven material of the first layer 1610. In some implementations, the fourth layer can be a layer of polyurethane or acrylic that is spread over the exposed nonwoven material through heat and pressure to bond the fibers. This will provide additional durability to the non-woven material. The fourth layer can be referred to as a bonding layer.

The multi-layer material 1602 is discussed with reference to the hand covering 1600, which is similarly shaped to the grip 100, of FIG. 1, the multi-layer material 1602 can be used to form any of the grips shown herein, or any other groups. For example, the multi-layer material can be used to form the grip 500 of FIG. 5A (e.g., the protective material of the grip 500), or the protective material 1110 of the grip 1100 shown in FIG. 11.

Figure 17:
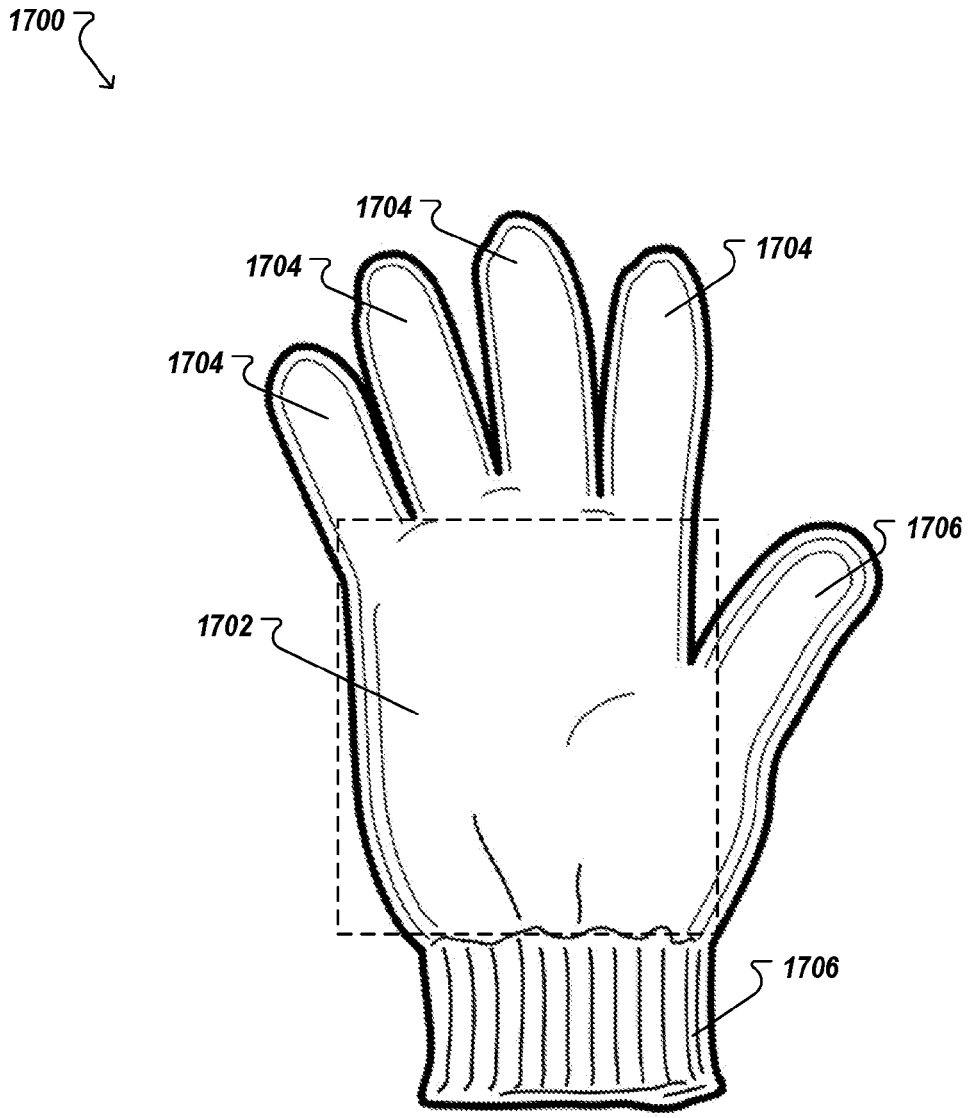
FIG. 17 is an illustration of an example glove formed using the multi-layer material.

FIG. 17 is an illustration of an example glove 1700 formed using the multi-layer material 1602. The surface of the glove 1700 that is shown in FIG. 17 is a palm face of the glove 1700. The opposite side of the glove 1700 (not shown) is referred to as a backhand face of the glove 1700 or another hand covering. The glove 1700 includes a palm protection area 1702 that is generally within the dashed rectangle. In some implementations, the palm protection area is formed using the multi-layer material 1602 discussed above with reference to FIGS. 16A-16B.

The glove 1700 also has one or more finger sleeves 1704 that are connected to the palm protection area 1702. In some implementations, the palm face surfaces of the finger sleeves 1704 are made of the same material as the palm protection area. In some implementations, the finger sleeves 1704 are made from different material. The finger sleeves 1704 are connected to the palm protection area 1702 at a finger end of the palm protection area 1702.

The glove 1700 is shown with four finger sleeves 1704, but the glove 1700 could have fewer finger sleeves, e.g., one, two, or three finger sleeves 1704. In situations, where the glove 1700 is formed with one finger sleeve 1704, the width of the single finger sleeve 1704 can be wide enough to receive four fingers, e.g., to form a mitten. Similarly, when other numbers of finger sleeves 1704 are used, they can be appropriately sized and spaced to accommodate different numbers of fingers. The finger sleeves 1704 shown in FIG. 17 are closed at a fingertip end, but the finger sleeves 1704 could be shorter with open ends so that fingers are able to protrude from the finger sleeves 1704.

The glove 1700 also includes a thumb sleeve 1706 on a side of the palm protection area 1702. The thumb sleeve 1706 is configured to receive a thumb when the glove 1700 is worn. Like the finger sleeves 1704, the thumb sleeve 1706 can be shorter and/or open ended so that the thumb is able to protrude from the thumb sleeve 1706. In some implementations, the thumb sleeve 1706 cold be omitted entirely, leaving an opening on the side of the glove 1700, adjacent to the palm protective area 1702.

The glove 1700 includes a wrist securing member 1708 at the wrist end of the palm protective area 1702. The wrist securing member 1708 is shown as elastic that is attached to the palm protection area, and provides a snug fit around the wrist when the glove 1700 is worn. Of course, the wrist securing member 1708 could be a wrist strap, a combination of elastic material and clasps, or other appropriate wrist securing members.

In some implementations, the backhand face of the glove 1700 (or another hand covering) can be made of a different material than the palm face of the hand covering. For example, if the palm face (or a portion thereof) of the glove is made using the multi-layer material 1602 discussed with reference to FIGS. 16A-16B, the backside face of the glove 1700 could be made from cloth, leather, or another appropriate material. In these implementations, the palm face and the backhand face can be sewn together, for example, along the edges of the different materials.

Figure 18:
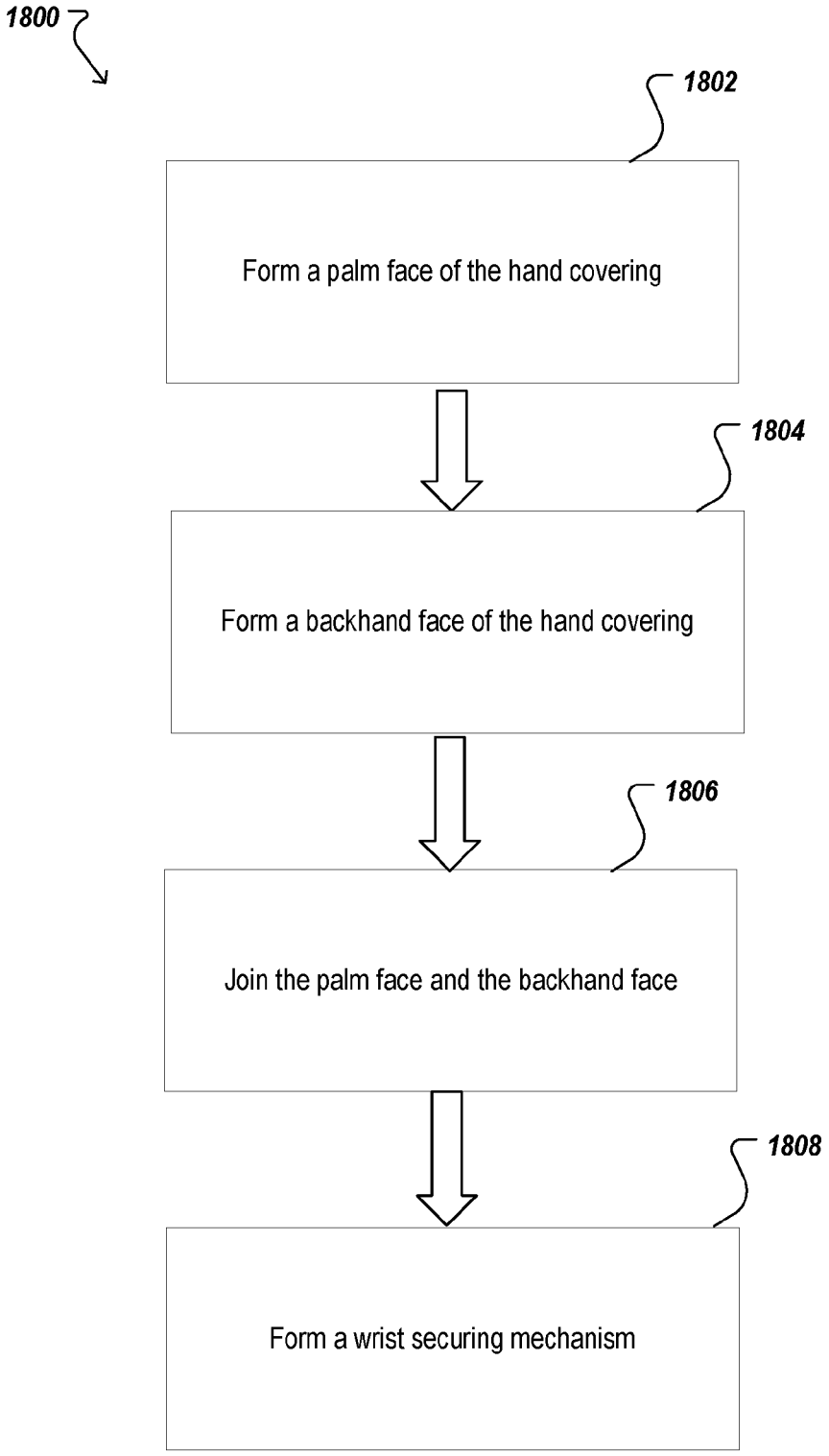
FIG. 18 is a flow chart of an example process for creating a glove Like reference numbers and designations in the various drawings indicate like elements.

FIG. 18 is a flow chart of an example process 1800 for creating a glove. The process 1800 can be used to manufacture or otherwise create gloves discussed throughout this specification.

A palm face of the hand covering is formed (1802). In some implementations, the palm face of the hand covering is formed, at least partially, using the multi-layer material 1602 discussed above with reference to FIGS. 16A-16B. For example, the palm face can include a palm protection area that is made of the multi-layer material 1602. The palm face can also include one or more finger sleeves that are formed at, or attached to, or otherwise connected to the finger end of the palm protection area. The palm face can also include a thumb sleeve that is formed at, attached to, or otherwise connected to a side of the palm protection area. In some implementations, all of the palm face can be formed using the multi-layer material 1602, while in other implementations, the multi-layer material may only be used in areas where hand protection is desired.

A backhand face of the hand covering is formed (1804). The backhand face of the hand covering can be formed in a similar manner as the palm side. In some implementations, the backhand face of the hand covering can be made from a different material than the palm face of the hand covering. For example, the backhand face of the hand covering can be cloth, leather, or another appropriate material, while the palm face of the hand covering may be the multi-layer material 1602. In some implementations, the backhand face of the hand covering can be made from the same material as a portion, or all, of the palm face of the hand covering.

The palm face and the backhand face are joined (1806). In some implementations, the edges of the palm face and the backhand face can be sewn together, glued together, or otherwise joined.

A wrist securing mechanism is formed (1808). In some implementations, the wrist securing mechanism can be formed separately from the palm face and/or backhand face, and sewn to the palm face and/or backhand face. In some implementations, the wrist securing mechanism can be made from a same continuous piece of material as the palm face and/or the backhand face. When the wrist securing mechanism is made from the same continuous piece of material as the palm face and/or the backhand face, the wrist securing mechanism can be formed, for example, by adding an elastic material, clasp, or another securing mechanism to that continuous piece of material.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A hand protector, comprising:

a protective material including:

a bottom edge defining a wrist end, wherein the bottom edge has a concave shape;

a top edge;

a first vertex of a first concave arc located on a first side of the protective material;

a second vertex of a second concave arc located on a second side of the protective material;

a first leg defined by a perimeter of the hand protector that is located between the first vertex and a third vertex of the bottom edge;

a second leg defined by the perimeter of the hand protector that is located between the second vertex and the third vertex of the bottom edge;

wherein:

a first angle of the first concave arc defined by a first axis and a second axis is ninety degrees or less;

the first axis passes through the first vertex and is tangential to a first edge of the first side of the protective material between the first vertex and the top edge;

the second axis passes through the first vertex and is tangential to a first portion of the first leg located between the first vertex and the bottom edge;

a second angle of the second concave arc defined by a third axis and a fourth axis is larger than the first angle;

the third axis passes through the second vertex and is tangential to a second edge of the second side of the protective material between the second vertex and the top edge;

the fourth axis passes through the second vertex and is tangential to a second portion of the second leg that is between the second vertex and the bottom edge.

2. The hand protector of claim 1, further comprising:

a wrist strap attached to the first leg; and a receiving loop configured to receive the wrist strap, wherein the receiving loop is attached to the second leg.

3. The hand protector of claim 1, wherein:

the protective material has a first width at a location of a fifth axis that passes through each of the first vertex and the second vertex;

a first convex arc of the first side is located between the fifth axis and the top edge;

a second convex arc of the second side is located between the fifth axis and the top edge;

the protective material has a second width at a location of a sixth axis that passes through a fourth vertex of the first convex arc and a sixth vertex of the second convex arc; and the second width is larger than the first width.

4. The hand protector of claim 3, wherein the first side is asymmetrical relative to the second side.

5. The hand protector of claim 1, wherein each of the first leg and the second leg include comfort padding that is secured to the protective material.

6. The hand protector of claim 1, wherein the protective material has zero finger holes defined therein.

7. The hand protector of claim 1, wherein the first vertex and the second vertex are located in a middle ⅓ section of the protective material, wherein a top ⅓ section of the protective material is located closer to the top edge than the middle ⅓ section, and a bottom ⅓ section of the protective material is located closer to the bottom edge of the protective material.

8. A method of forming a protective material, comprising:

forming a bottom edge defining a wrist end, wherein the bottom edge has a concave shape;

forming a top edge;

forming a first concave arc, wherein a first vertex of the first concave arc is located on a first side of the protective material;

forming a second concave arc, wherein a second vertex of the second concave arc is located on a second side of the protective material;

forming a first leg, wherein the first leg is defined by a perimeter of the protective material that is located between the first vertex and a third vertex of the bottom edge;

forming a second leg, wherein the second leg is defined by the perimeter of the protective material that is located between the second vertex and the third vertex of the bottom edge;

wherein:

a first angle of the first concave arc defined by a first axis and a second axis is ninety degrees or less;

the first axis passes through the first vertex and is tangential to a first edge of the first side of the protective material between the first vertex and the top edge;

the second axis passes through the first vertex and is tangential to a first portion of the first leg located between the first vertex and the bottom edge;

a second angle of the second concave arc defined by a third axis and a fourth axis is larger than the first angle;

the third axis passes through the second vertex and is tangential to a second edge of the second side of the protective material between the second vertex and the top edge;

the fourth axis passes through the second vertex and is tangential to a second portion of the second leg that is between the second vertex and the bottom edge.

9. The method of claim 8, further comprising:

attaching a wrist strap to the first leg; and attaching a receiving loop to the second leg, wherein the receiving loop is configured to receive the wrist strap.

10. The method of claim 8, wherein the protective material has a first width at a location of a fifth axis that passes through each of the first vertex and the second vertex, the method further comprising:

forming a first convex arc of the first side, wherein the first convex arc is located between the fifth axis and the top edge; and forming a second convex arc of the second side, wherein the second convex arc is located between the fifth axis and the top edge, wherein:

the protective material has a second width at a location of a sixth axis that passes through a fourth vertex of the first convex arc and a sixth vertex of the second convex arc; and the second width is larger than the first width.

11. The method of claim 10, wherein the first side is formed to be asymmetrical relative to the second side.

12. The method of claim 8, further comprising securing comfort padding to the protective material such that each of the first leg and the second leg include the comfort padding.

13. The method of claim 8, wherein the protective material has zero finger holes defined therein.

14. The method of claim 8, wherein the first vertex and the second vertex are located in a middle ⅓ section of the protective material, wherein a top ⅓ section of the protective material is located closer to the top edge than the middle ⅓ section, and a bottom ⅓ section of the protective material is located closer to the bottom edge of the protective material.

* * * * *